US007377803B2

(12) United States Patent
Matsuoka

(10) Patent No.: US 7,377,803 B2
(45) Date of Patent: May 27, 2008

(54) CONNECTOR AND CONNECTOR SYSTEM

(75) Inventor: Hiroyuki Matsuoka, Midori-Kanagawa pref. (JP)

(73) Assignee: 3M Innovative Properties Company, St. Paul, MN (US)

( * ) Notice: Subject to any disclaimer, the term of this patent is extended or adjusted under 35 U.S.C. 154(b) by 12 days.

(21) Appl. No.: 10/576,844

(22) PCT Filed: Sep. 22, 2004

(86) PCT No.: PCT/US2004/031258

§ 371 (c)(1),
(2), (4) Date: Apr. 20, 2006

(87) PCT Pub. No.: WO2005/043687

PCT Pub. Date: May 12, 2005

(65) Prior Publication Data

US 2007/0134946 A1 Jun. 14, 2007

(51) Int. Cl.
*H01R 12/24* (2006.01)

(52) U.S. Cl. ..... 439/497; 439/499; 439/579

(58) Field of Classification Search ..... 439/492, 439/499, 497, 579, 607, 610
See application file for complete search history.

(56) References Cited

U.S. PATENT DOCUMENTS

| | | | | |
|---|---|---|---|---|
| 4,464,002 | A | 8/1984 | Suzuki et al. | |
| 4,632,486 | A | 12/1986 | Hasircoglu | |
| 5,885,092 | A | 3/1999 | Ito et al. | |
| 5,888,076 | A | 3/1999 | Itoh et al. | |
| 5,902,146 | A | 5/1999 | Hanami | |
| 6,039,611 | A | 3/2000 | Yang | |
| 6,217,344 | B1 * | 4/2001 | Saito et al. | 439/67 |
| 6,250,953 | B1 | 6/2001 | Niitsu | |
| 6,296,524 | B1 | 10/2001 | Goto | |
| 6,358,083 | B1 | 3/2002 | Kraft | |
| 6,419,502 | B1 | 7/2002 | Trammel | |
| 6,648,697 | B2 | 11/2003 | Yang | |
| 6,830,478 | B1 * | 12/2004 | Ko | 439/579 |
| 6,905,366 | B2 | 6/2005 | Yang | |
| 7,040,917 | B2 * | 5/2006 | Yagi et al. | 439/495 |
| 7,070,444 | B2 | 7/2006 | Sato et al. | |
| 7,172,455 | B2 * | 2/2007 | Pabst et al. | 439/496 |
| 7,192,300 | B2 * | 3/2007 | Hashiguchi et al. | 439/497 |
| 7,201,606 | B2 * | 4/2007 | Matsuoka | 439/499 |
| 7,220,146 | B2 * | 5/2007 | Miyazaki | 439/579 |
| 2002/0006744 | A1 | 1/2002 | Tashiro | |

FOREIGN PATENT DOCUMENTS

| | | |
|---|---|---|
| EP | 1337009 | 8/2003 |
| JP | 2000-277190 | 10/2000 |
| JP | 2002-025667 | 1/2002 |

* cited by examiner

*Primary Examiner*—Hien Vu
(74) *Attorney, Agent, or Firm*—Melanie G. Gover

(57) ABSTRACT

A connector is provided with a terminal element including a conductor-connecting section connectable to a conductor of an electric wire and a contact section capable conductively contacting with a corresponding terminal element of a counterpart connector, an electrically insulating body for supporting the terminal element while exposing the conductor-connecting section and the contact section, and an abutting member assembled with the body and bringing the wire conductor into abutment with the conductor-connecting section under pressure. The body includes a fining portion capable of fining with a counterpart connector while positioning the contact section with respect to the corresponding terminal element. The conductor-connecting section and the contact section are arranged to be aligned with each other generally orthogonal to a connector fitting direction defined by the fitting portion.

8 Claims, 14 Drawing Sheets

CONNECTOR AND CONNECTOR SYSTEM

CROSS REFERENCE TO RELATED APPLICATIONS

This application is a national stage filing under 35 U.S.C. 371 of PCT/US2004/031258, filed Sep. 22, 2004, which claims priority to Japanese Application No. 2003-360695, filed Oct. 21, 2003.

TECHNICAL FIELD

The present invention relates to a connector having a wire connection structure of a conductor abutting type which brings the conductor-connecting sections of terminal elements and the conductors of wires into contact with each other with pressure. The invention further relates to a connector for a circuit board that can be connected to a connector having a wire connection structure of the conductor abutting type. The invention further relates to a connector system for connecting cables to a substrate.

BACKGROUND ART

As structures for mutually connecting terminal elements of connectors and wire conductors to each other, there have been known a structure in which conductor-connecting sections of terminal elements are plastically deformed and are connected (caulked) to conductors that are exposed by removing the sheath over a required length at ends of the wires (so-called crimp structure), and a structure in which slits of a width smaller than the diameter of the conductors are formed in the conductor-connecting sections of the terminal elements so as to possess a sharp outer shape, and the conductor-connecting sections are stabbed into the sheath of the wires to press-fit the conductor into the slits to accomplish the connection (so-called insulation-displacement structure). With these known electric wire connection structures, however, it is becoming difficult to cope with the decreasing diameters of the wire conductors and the decreasing pitches of the terminal arrangement to meet a level required by high-density connection of recent years in regard to both connection operability and terminal machinability. To realize a connector capable of coping with high-density connection, therefore, there have been proposed a variety of connectors having a wire connection structure of a conductor abutting type in which conductors exposed by removing the sheath over a required length at ends of the wires are abut to the conductor-connecting sections of the terminal elements under the application of a pressure (see, for example, patent literatures 1 and 2).

The connector disclosed in the patent literature 1 can be applied to a flattened coaxial cable, and includes a plurality of terminal elements each having a conductor-connecting section connected to the cable conductor, an electrically insulating body for supporting the terminal elements with the conductor-connecting sections being exposed, and a plurality of abutting members assembled with the body and for separately abutting the cable conductors to the conductor-connecting sections of the terminal elements with pressure. In this connector, each of the plurality of terminal elements (base contacts) is provided with a conductor-connecting section having a folded outer edge, and each of the plurality of abutting members (support contacts) formed of the conducting metal pieces same as the terminal elements is provided with an abutting surface of a folded shape corresponding to the folded outer edge of the conductor-connecting section of the terminal element. The body supporting the terminals which are spaced apart by a predetermined distance and in alignment, and an electrically insulating cover supporting the abutting members spaced apart by a corresponding distance and in alignment, are assembled together in a direction to intersect the direction in which the cables extend in a state where the cables to be connected are arranged therebetween. Then, the conductors of the cables are securely held between the corresponding terminal elements and the abutting members being forcibly caused to stay along the outer edges of the conductor-connecting sections of the terminal elements and along the folded abutting surfaces of the abutting members with pressure.

[Patent literature 1]

Japanese Unexamined Patent Publication (Kokai) No. 2000-277190

The connector disclosed in the patent literature 2 is the one for a flat cable for connecting the flat cable to a printed board, and includes a plurality of terminal elements each having a conductor-connecting section connected to the cable conductor, an electrically insulating body for supporting the terminal elements with the conductor-connecting sections being exposed, and abutting members assembled with the body and for separately abutting the cable conductors to the conductor-connecting sections of the terminal elements with pressure. In this connector, each of the plurality of terminal elements is provided with a cantilevered beam-like conductor-connecting section. The flat cables are placed on a group of terminal elements with the corresponding conductors being contacted to the conductor-connecting sections. In this state, if the conductor-connecting sections of the group of terminal elements are pressed and attached to the body while bringing an abutting member (pressing plate) made of a piece of metal plate into contact with the outer surfaces (ground surfaces) of the flat cables, then, the conductor-connecting sections of the individual terminals are resiliently deflected, and the corresponding conductors of the flat cables are connected to the conductor-connecting sections with pressure.

[Patent literature 2]

Japanese Unexamined Patent Publication (Kokai) No. 2002-25667

As a general constitution, each terminal element of the connector has a contact section that comes into conductive contact with the corresponding terminal element of the counterpart connector, and the insulating body of the connector has a fitting portion that fits to the counterpart connector while arranging the contact sections of the terminal elements in an exposed manner and positioning the contact sections for the corresponding terminal elements. In the connector of the patent literature 1, the connector fitting direction (direction in which the connector moves for properly fitting the fitting portion to the complementary fitting portion of the counterpart connector) defined by the fitting portion of the body, is nearly in parallel with the direction in which the wires (flat cables) extend on the body. In the connector of the above patent literature 2, the connector fitting direction defined by the fitting portion of the body is nearly at right angles with the direction in which the wires (flat cables) extend on the body.

DISCLOSURE OF THE INVENTION

In the structure for connecting electric wires of the connector disclosed in the above patent literature 1, the conductors of the wires are held between the abutting surfaces of the abutting members and the outer edges of the conductor-connecting sections of the terminal elements having folded shapes and facing each other with pressure which is produced by moving the terminal elements and the abutting members relative to each other. During the work for connecting the electric wires, therefore, the conductors of the wires are rubbed against the metal pieces with pressure, and the conductors may be damaged. In this connector, further, the connector fitting direction is nearly in parallel with the direction in which the wires extend on the body and, besides, the individual terminal elements have conductor-connecting sections at positions substantially in alignment in the connector fitting direction relative to the contact section. Therefore, the depth of the connector (external size along the fitting direction or the direction in which the wire extends) tends to increase.

In the connector disclosed in the above patent literature 2, on the other hand, the connector fitting direction is nearly at right angles with the direction in which the wire extends on the body. Therefore, the depth of the connector does not basically increase. Even in the constitution disclosed in the patent literature 2, however, the conductor-connecting sections are located at positions where the individual terminals are substantially aligned in the connector fitting direction relative to the contact section, causing an increase in the height of the connector (external size in a direction nearly at right angles with the direction in which the wire extends). In the field of connectors for connecting the cables and the substrate, in particular, the external size of the connector directly affects the mounting space of the circuit board. Accompanying the recent development in the technology of highly dense mounting, it has been urged to decrease the diameter of the cable conductors, to decrease the pitch in the terminal arrangement as well as to further decrease the external size of the connector.

In the connectors, in general, it is becoming difficult to form a complementary fitting portion that is capable of maintaining a state in which the corresponding terminal elements are in contact maintaining stability in a pair of connectors that are connected to each other due to a decrease in the external size as described above. In the field of the connectors for connecting the cables to the substrate, in particular, the circuit board is usually secured due to its structures whereas external force such as tensile force or twisting force tends to be exerted on the cables. Therefore, the connectors must be so contrived as to maintain a state where the connector for the cables and the connector for the circuit board are connected to each other maintaining stability overcoming the external force.

It is an object of the present invention to provide a connector having a wire connection structure of the conductor abutting type in which the conductors of wires are abut to the conductor-connecting sections of the terminal elements with pressure, while decreasing the external size of the connector as much as possible without impairing the stability and reliability in the connection between the terminal elements and the conductors.

It is another object of the present invention to provide a connector having a wire connection structure of the conductor abutting type, which makes it possible to decrease the external size and to avoid damages to the wire conductors during the work of wire connection.

It is a further object of the present invention to provide a connector for a circuit board capable of being connected to a connector having a wire connection structure of the conductor abutting type, which makes it possible to stably maintain a connection to a counterpart connector even when the external size is decreased so as to meet the highly dense mounting of the circuit board.

It is a still further object of the present invention to provide a connector system for connecting cables to a substrate, which makes it possible to decrease the external size so as to meet the highly dense mounting of the circuit board, and to stably maintain a state where the connectors are connected together.

Means for Solving the Problems

In order to achieve the above object, the invention according to claim 1 provides a connector comprising a terminal element including a conductor-connecting section connectable with a conductor of an electric wire and a contact section capable of coming into conductive contact with a corresponding terminal element of a counterpart connector; an electrically insulating body for supporting said terminal element while exposing said conductor-connecting section and said contact section; and an abutting member assembled with said body to bring the conductor of the wire into abutment with said conductor-connecting section of said terminal element under pressure; wherein said body includes a fitting portion capable of fitting to the counterpart connector while positioning said contact section of said terminal element with respect to the corresponding terminal element; and wherein said conductor-connecting section and said contact section of said terminal element are arranged to be aligned with each other in a direction intersecting a connector fitting direction determined by said fitting portion.

The invention according to claim 2 provides the connector of claim 1, wherein said body includes a wire-holding section for locating the wire on a backside of said fitting portion as seen in said connector fitting direction, and wherein said connector fitting direction intersects an extending direction of the wire on said body, said extending direction defined by said wire-holding portion.

The invention according to claim 3 provides the connector of claim 1 or 2, wherein said body includes a first support member having said fitting portion and supporting said terminal element, and a second support member having a bearing surface facing said conductor-connecting section of said terminal element supported on said first support member and supporting the wire while positioning the conductor on said bearing surface; said first support member and said second support member being combined together in such a manner as to dispose said conductor between said conductor-connecting section and said bearing surface.

The invention according to claim 4 provides the connector of claim 3, wherein said abutting member includes a pressing surface acting to press said conductor-connecting section of said terminal element supported on said first support member toward said bearing surface of said second support member, when said abutting member is assembled with said body.

The invention according to claim 5 provides the connector of claim 3 or 4, further comprising a first shield member incorporated in said second support member and a second shield member incorporated in said abutting member in such a manner as to come into conductive contact with said first shield member; said first and second shield members being arranged at a position substantially surrounding said conductor-connecting section of said terminal element and the conductor of the wire in a non-contacting manner.

The invention according to claim 6 provides the connector of claim 5, wherein the wire is a coaxial cable, and wherein said first and second shield members are capable of being electrically connected to a shielding of the coaxial cable supported on said second support member.

The invention according to claim 7 provides the connector of any one of claims 1 to 6, wherein said contact section of said terminal element has a curved shape capable of conductively contacting with the corresponding terminal element of the counterpart connector at a plurality of points simultaneously, and wherein said fitting portion of said body includes a protruding support surface along which said contact section of said terminal element is securely supported.

The invention according to claim 8 provides a connector comprising a plurality of terminal elements respectively including lead sections connectable with a circuit board and contact sections capable of coming into conductive contact with corresponding terminal elements of a counterpart connector, and an electrically insulating body for supporting said plurality of terminal elements while exposing said lead sections and said contact sections; wherein said body includes a fitting portion capable of fitting to the counterpart connector while positioning said contact sections of said terminal elements with respect to the corresponding terminal elements; wherein each of said contact sections of said plurality of terminal elements includes a first contact point fixedly arranged on said fitting portion and a second contact point spaced to be oppositely facing said first contact point in an elastically displaceable manner; and wherein said plurality of terminal elements are disposed on said fitting portion in a parallel arrangement with said contact sections being alternately reversed, in such a manner that, among two terminal elements arranged side-by-side, said first contact point of one terminal element is aligned with said second contact point of the other terminal element.

The invention according to claim 9 provides a connector system comprising a connector according to any one of claims 1 to 7 and a connector according to claim 8, in a manner that they can be connected to each other.

Effects of the Invention

According to the invention of claim 1, the conductor-connecting sections of the terminal elements and the contact sections are arranged in alignment in a direction intersecting the connector fitting direction. Therefore, the structure for connecting the conductor-connecting sections of the terminal elements to the conductors of the wires can be arranged being suitably deviated in a direction to intersect the connector fitting direction relative to the fitting portion of the body. As a result, an increase in the height of the connector (external size in the connector fitting direction) can be effectively avoided. The connector employs a wire connection structure of a very simple conductor abut type in which the conductor-connecting sections of the terminal elements are pressed onto the conductors of the wires so as to be connected thereto. Therefore, the above characteristic arrangement of the terminal elements does not at all affect the connection between the terminal elements and the wires. According to the present invention, therefore, the external size (particularly, height) of the connector can be decreased as much as possible without impairing the stability and reliability of connection between the terminal elements and the wire conductors.

According to the invention of claim 2, the connector fitting direction is nearly at right angles with the direction in which the wires extend on the body. Basically, therefore, it is allowed to avoid an increase in the depth of the connector (external size along the direction in which the wires extend). Besides, the wires are arranged on the back side of the fitting portion as seen in the connector fitting direction. Therefore, an increase in the depth of the connector is effectively avoided even when the connection structure between the conductor-connecting sections of the terminal elements and the conductors of the wires is arranged being deviated in a direction to intersect the connector fitting direction relative to the fitting portion.

According to the invention of claim 3, the body is divided into the first support member and the second support member, and the conductors of the wires to be connected are arranged in advance between the conductor-connecting sections of the terminal elements supported by the first support member and the bearing surfaces of the second support member. During the work for connecting the wires, therefore, there does not occur such a situation that the wire conductors are rubbed against the metal piece with pressure, and there is no probability that the wire conductors are damaged.

According to the invention of claim 4, the abutting member is simply assembled with the body such that the pressing surface of the abutting member presses the conductor-connecting sections of the terminal elements against the corresponding bearing surfaces. Therefore, a required contacting pressure is easily maintained between the terminal elements and the wire conductors.

According to the invention of claim 5, the first shield member comes into conductive contact with the second shield member when the connector is assembled substantially surrounding the conductor-connecting sections of the terminal elements and the wire conductors connected thereto in a non-contacting manner. By connecting the first and second shield members to the ground potential, therefore, a shielding structure is established for the signal transmission path in the connector, and the connector exhibits improved high-speed transmission characteristics.

According to the invention of claim 6, a shielding structure of a high level is established by using the first and second shield member of a potential equal to that of the shieldings of coaxial cables so will not to impair excellent high-speed transmission characteristics possessed by the coaxial cables.

According to the invention of claim 7, there is established a constitution in which the corresponding terminal elements are in electric contact at a plurality of points in the connector system which is constituted by a connector and a counterpart connector. Therefore, even when the size of the terminal element is decreased so as to meet a high-density connection structure, improved reliability is maintained in the electric contact.

According to the invention of claim 8, the terminal elements in the board connector are arranged with their contact sections alternately reversed. Therefore, while the terminal elements are brought into contact with the corresponding terminal elements of the counterpart connector, the restoring force due to the resilient displacement of the second contact points is exerted onto the corresponding terminal elements being totally balanced concerning the direction. The thus balanced resilient restoring force of the terminal elements works together with the fit-holding ability of the counterpart connector to which the fitting portion is fitted thereby to stably maintain a state where the corresponding terminal elements are electrically connected together, i.e., where the two connectors are properly connected to each other even when the external force is exerted on the counterpart connector relative to the board connector irrespective of the direction of the external force. The stably holding function owing to the characteristic arrangement of the group of terminal elements can be effectively exhibited even when the external size of the board connector is decreased so as to meet the highly dense mounting of the circuit board.

According to the invention of claim 9, the external size of the connector system as a whole is effectively decreased accompanying a decrease in the external size of the connector described in any one of claims 1 to 7, and mounting space of the circuit board to which the connector system is to be applied can be effectively maintained to meet the technology for highly dense mounting. Besides, owing to the above characteristic fitting structure of the connector described in claim 8, the connector system stably maintains a state where the two connectors are properly connected together.

BEST MODE FOR CARRYING OUT THE INVENTION

Figure 1:
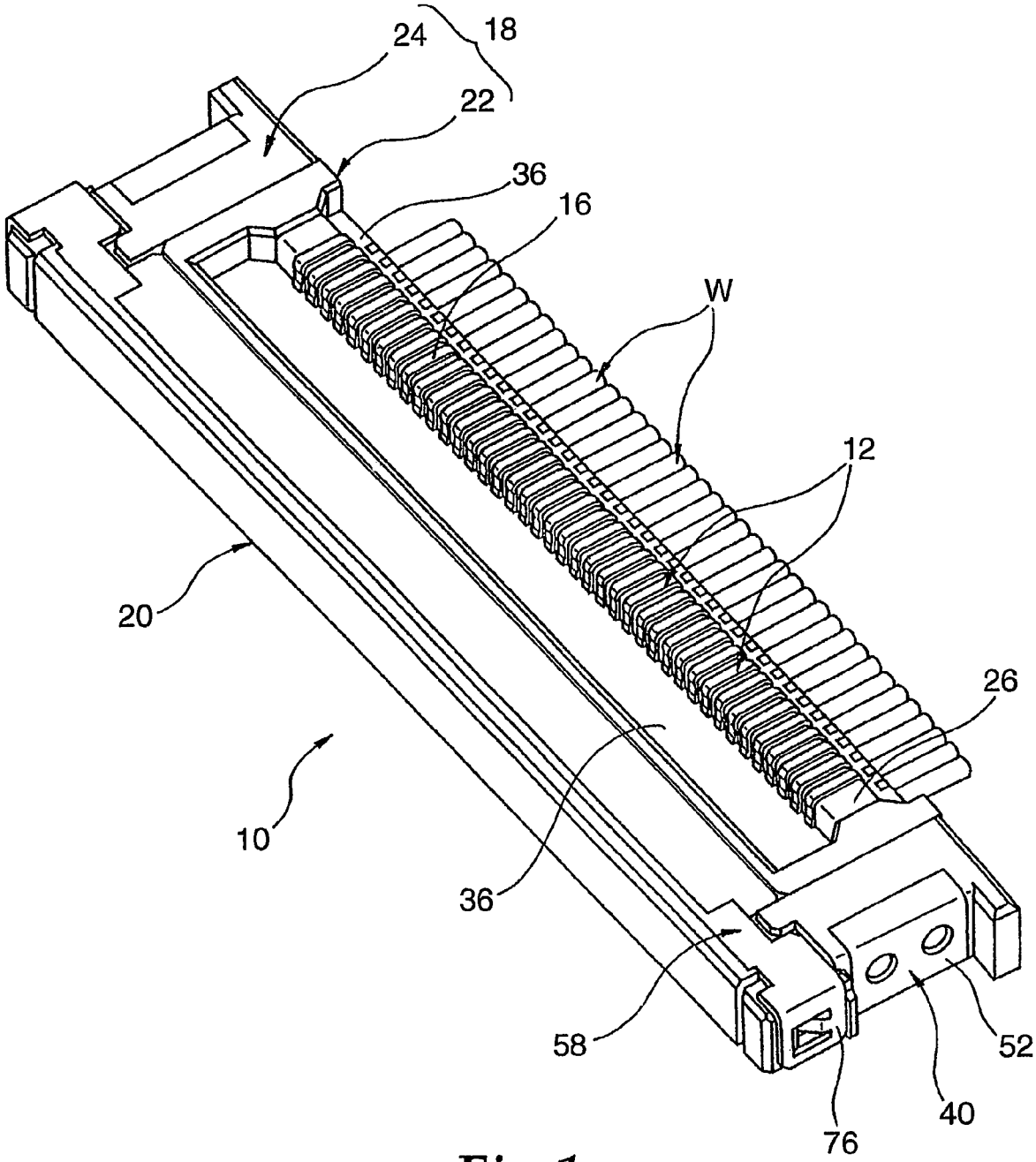
FIG. 1 is a perspective view illustrating a state of assembling a connector according to an embodiment of the present invention after the wires have been connected.

An embodiment of the invention will now be described in detail with reference to the accompanying drawings. In the drawings, the corresponding constituent elements are denoted by the same reference numerals.

Figure 2:
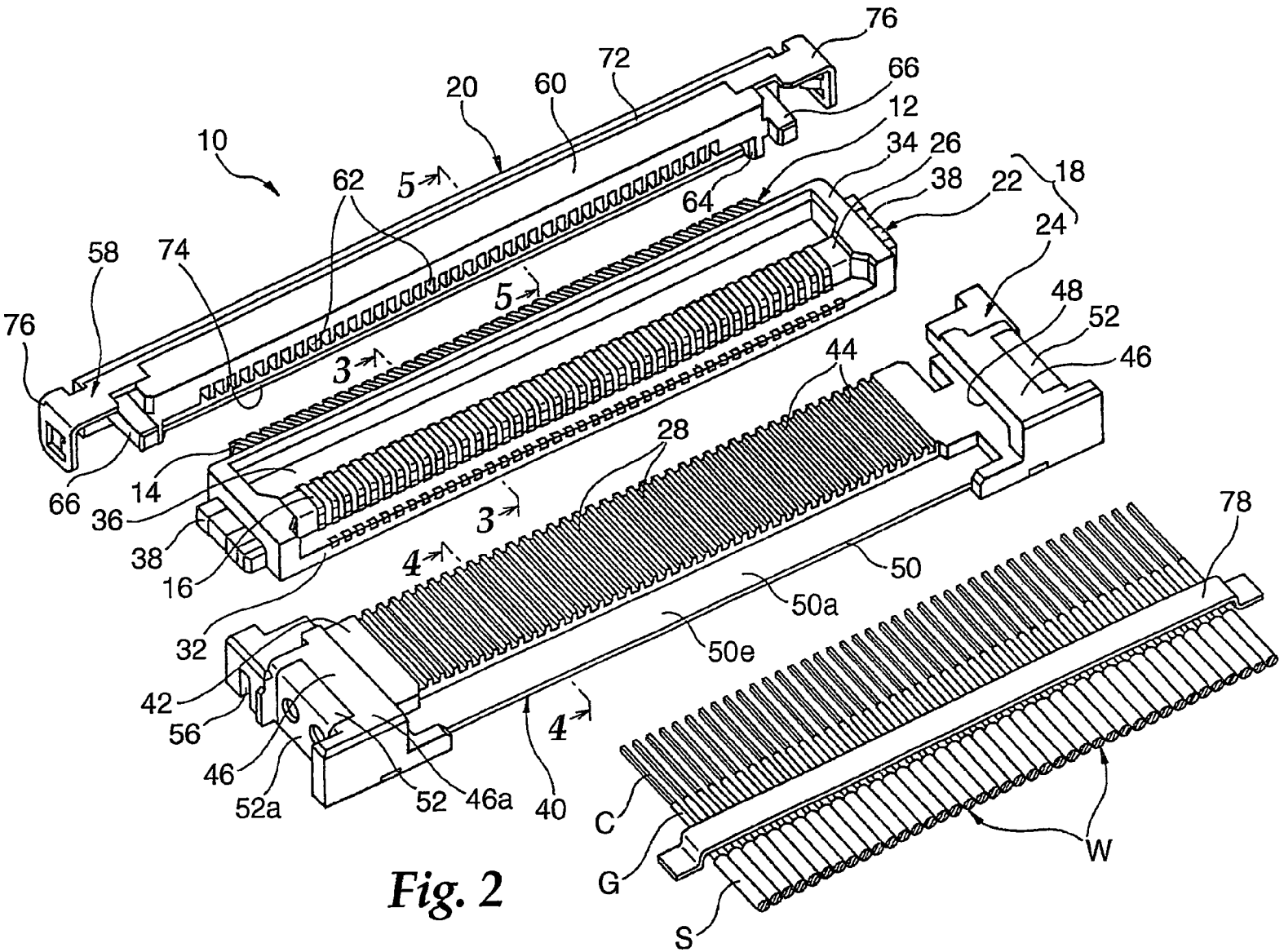
FIG. 2 is a perspective view illustrating the connector of FIG. 1 in a disassembled manner.
Figure 3:
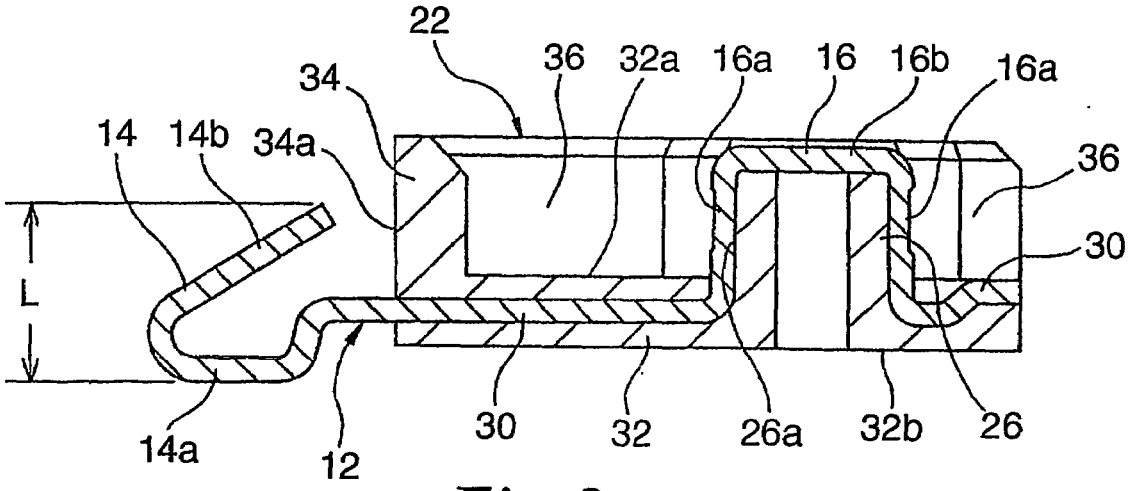
FIG. 3 is a sectional view of a first support member in the connector of FIG. 1 along a line III-III.
Figure 4:
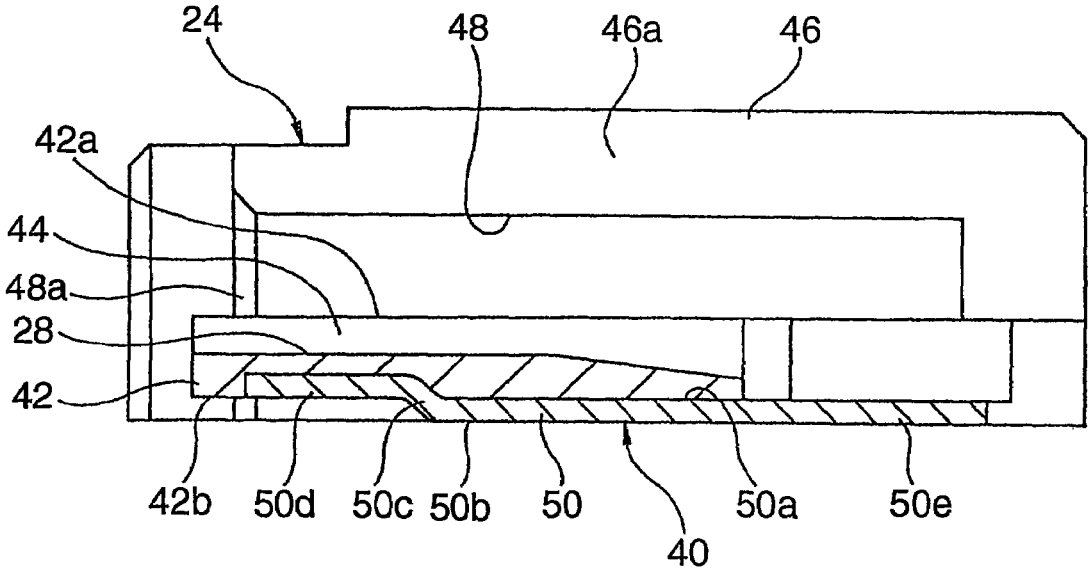
FIG. 4 is a sectional view of a second support member in the connector of FIG. 1 along a line IV-IV.
Figure 5:
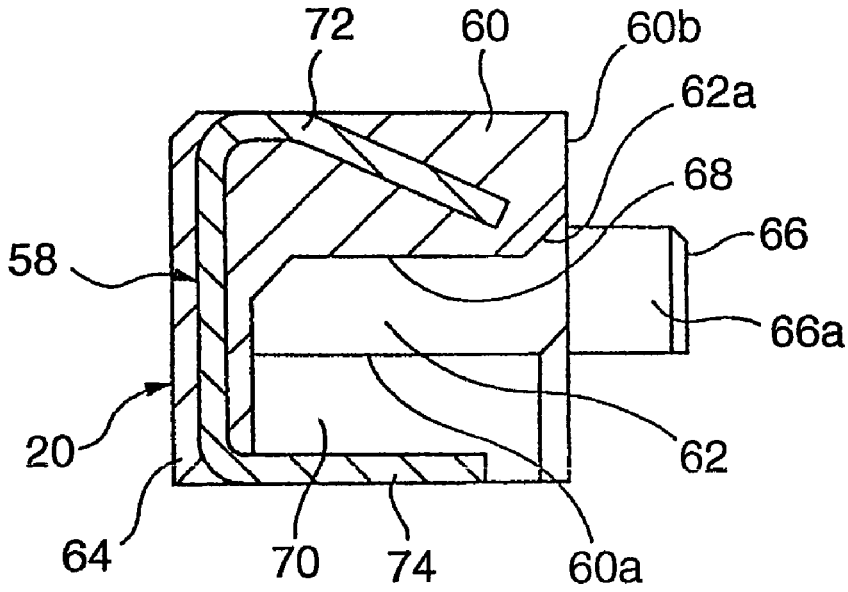
FIG. 5 is a sectional of an abutting member in the connector of FIG. 1 along a line V-V.

FIG. 1 is a perspective view illustrating a state where a connector 10 is assembled according to an embodiment of the present invention, FIG. 2 is a perspective view illustrating the connector 10 in a disassembled manner, and FIGS. 3 to 5 are sectional views illustrating principal constituent elements of the connector 10. The connector 10 has a wire connection structure of a conductor abut type in which a conductor C exposed by removing a sheath S at an end of a wire W over a required length is connected being abut to a conductor-connecting section 14 of a terminal element 12. The connector 10 can be advantageously used for connecting a multi-core flat coaxial cable to a circuit board. In this case, the other connector (referred to as counterpart connector in this specification) to which the connector 10 is to be connected, is constituted as a board connector mounted on a circuit board. However, the connector according to the present invention is not limited to the above use only but can be realized as a variety of connectors adapted to other forms of connection.

The connector 10 includes a plurality of terminal elements 12 having conductor-connecting sections 14 connected to conductors C of wires W and contact section 16 that come into conductive contact with corresponding terminal elements (not shown) of a counterpart connector, an electrically insulating body 18 for supporting the terminal elements 12 while exposing the conductor-connecting sections 14 and the contact sections 16, and an abutting member 20 assembled with the body 18 and brings the conductors C of the wires W into abut with the conductor-connecting sections 14 of the terminal elements 12 with pressure. The body 18 is constituted by securely combining together a first support member 22 that supports a plurality of terminal elements 12 and a second support member 24 that supports a plurality of wires W. The first support member 22 has a fitting portion 26 that fits to the counterpart connector while positioning the contact sections 16 of the terminal elements 12 relative to the corresponding terminal elements of the counterpart connector. The second support member 24 is provided with a plurality of bearing surfaces 28 facing the conductor-connecting sections 14 of the terminal elements 12 supported by the first support member 22.

The terminal elements 12 of the connector 10 all have the same shape and size, are integrally mounted on the first support member 22 of the body 18 through, for example, a step of insert-molding, and are supported being arranged maintaining a predetermined equal distance in parallel with each other. Each terminal element 12 is a pin-like member formed in a predetermined shape by, for example, press-molding a metal plate having good electric conduction, and includes, integrally together, an end buried in the first support member 22, intermediate buried sections 30, a contact section 16 extending between the buried sections 30 and exposed on the surface of the fitting portion 26 of the first support member 22, and a conductor-connecting section 14 on the other side extending from the intermediate buried section 30 toward the side opposite to the contact section 16 and protruding to the outer side of the first support member 22. The buried portion 30 at one end of the terminal 12 is extending from the contact section 16 like a crank, and the intermediate buried section 30 is extending straight between the conductor-connecting section 14 and the contact section 16.

Figure 6:
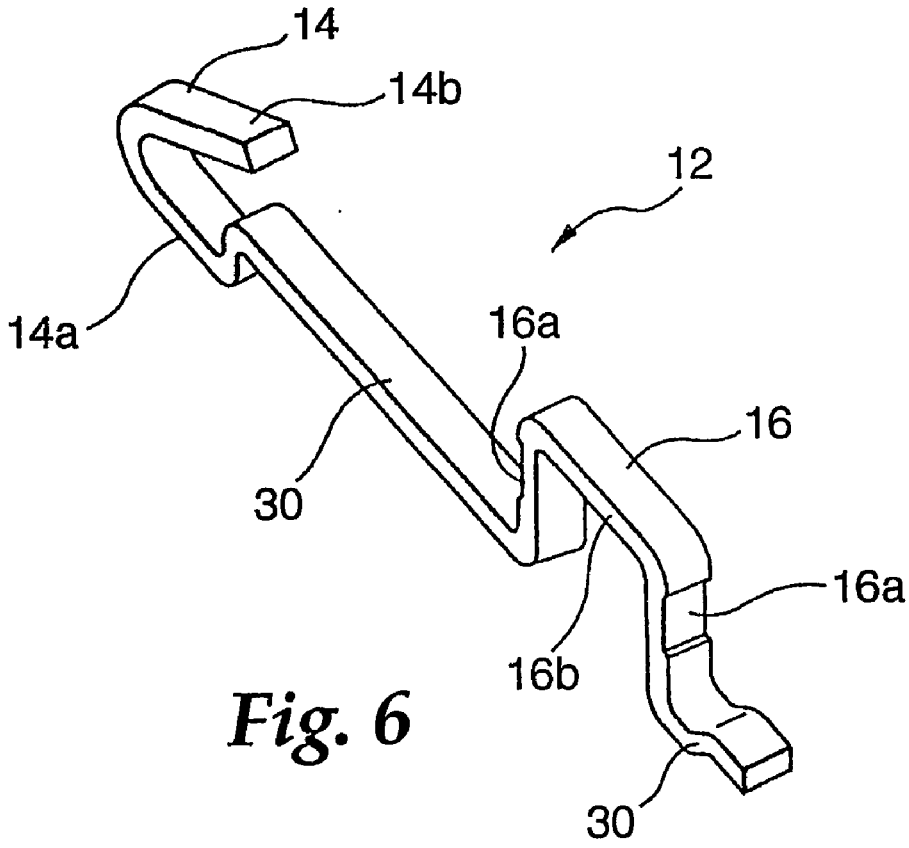
FIG. 6 is a perspective view of a terminal element in the connector of FIG. 1.

The conductor-connecting section 14 of the terminal element 12 has an arm section 14*a* connected straight to the intermediate buried section 30 and is extending like a crank, and a pressure-receiving section 14*b* connected to an end of the arm section 4*a* in a folded manner and is extending in a direction to intersect the arm section 14*a* at an acute angle (FIG. 6). The conductor-connecting section 14 is supported by the first support member 22 like a cantilevered beam and is capable of resiliently deflecting as a whole upon receiving an external force. In particular, the pressure-receiving portion 14*b* can be resiliently deflected in a direction to approach the arm section 4*a* upon receipt of the external force to produce a resilient force that varies in proportion to the amount of deflection. In a no-load state where the conductor-connecting section 14 is not deformed, the arm section 14*a* and the pressure-receiving section 14*b* of the conductor-connecting section 14 are arranged being separated away by a maximum distance L (FIG. 3).

The contact section 16 of the terminal element 12 has a pair of contact point lengths 16*a* connected to the two buried sections 30 in a folded manner and extending in a direction to meet the buried sections 30 nearly at right angles, and a beam section 16*b* connected to the contact point lengths 16*a* in a folded manner and is extending between the two contact point lengths 16*a* (FIG. 6). Being thus folded, the contact section 16 comes, at the exposed end surfaces of the two contact point lengths 16*a*, into electric contact at two places simultaneously with the corresponding terminal element of the counterpart connector as will be described later. The contact section 16 is formed at a position in linear alignment with the conductor-connecting section 14.

The first support member 22 constituting the body 18 is integrally formed by, for example, injection-molding an electrically insulating resin material incorporating therein a plurality of terminal elements 12 in a predetermined arrangement as described above. The first support member 22 includes a flat plate-like base portion 32 of a nearly rectangular shape as seen in a plan view, in a buried manner, the buried portions 30 of the terminal elements 12, a fitting portion 26 protruding at an intermediate position on a surface 32*a* of the base portion 32 and linearly extending in the lengthwise direction, and edge walls 34 protruding from outer edges of the surface 32*a* of the base portion 32 and are extending in a U-shape as seen in a plan view. It is also allowable to employ a constitution in which terminals of a suitable shape are incorporated in the first support member which has been molded in a suitable shape in advance instead of the illustrated constitution in which a plurality of terminal elements 12 are insert-molded in the first support member 22. The invention is not to limit the number of terminal elements that are incorporated, and can further be applied even to a connector having a single terminal element.

The fitting portion 26 has a protruding support surface of a U-shape in cross section for securely supporting the contact sections 16 of the terminal elements 12 along the surface thereof. The base portion 32 has a nearly flat outer surface 32*b* on the side opposite to the front surface 32*a*, and the edge walls 34 have outer surfaces 34*a* on the sides separated away from the fitting portion 26. The conductor-connecting section 14 of the terminal element 12 protrudes nearly upright from the outer surface 34*a* of the edge wall 34 of the first support member 22 and further extends at an end region of the arm section 14*a* like a crank toward the outer side beyond the outer surface 32*b* of the base portion 32 (FIG. 3).

Among the fitting portion 26, base portion 32 and edge walls 34 of the first support member 22, there are formed a pair of recesses 36 on both sides of the fitting portion 26 as seen in the transverse direction of the first support member 22 to accept portions of the counterpart connector. Further, a pair of protuberances 38 are protruding outward from the edge walls 34 at opposite ends in the lengthwise direction of the first support member 22, and are extending in a direction nearly in parallel with the surface 32*a* of the base portion.

Here, each of the contact sections 16 of the terminal elements 12 supported in alignment on the protruding support surface 26*a* of the fitting portion 26, works as a male contact section having a pair of contact point lengths 16*a* and is expanding, and accomplishes an electric contact being complementarily inserted in a female contact section (not shown) of a corresponding terminal element of the counterpart connector accepted by the recesses 36 of the first support member 22. Therefore, the fitting direction of the connector 10 (direction in which the connector 10 moves to properly fit the fitting portion 26 to the complementary fitting portion of the counterpart connector) defined by the fitting portion 26 of the body 18, is in agreement with the direction in which are extending the contact point lengths 16*a* of the contact sections 16 of the terminal elements 12 (i.e., direction nearly at right angles with the buried portions 30 of the terminal elements 12). In the connector 10, therefore, the conductor-connecting sections 14 and the contact sections 16 of the terminal elements 12 are arranged in alignment in a direction nearly at right angles with the connector fitting direction defined by the fitting portion 26.

The second support member 24 of the body 18 is integrally formed by, for example, injection-molding an electrically insulating resin material while incorporating therein a first shield member 40 that will be described later in a predetermined arrangement. The second support member 24 includes a flat plate-like base portion 42 of nearly a rectangular shape as seen in a plan view and having a plurality of grooves in one surface 42*a* thereof, and a pair of engaging sections 46 protruded on the surface 42*a* of the base portion 42 at opposing ends in the lengthwise direction thereof. It is also allowable to employ a constitution in which the first shield member of a suitable shape is incorporated in the second support member which has been molded in a suitable shape in advance instead of the illustrated constitution in which the first shield member 40 is insert-molded in the second support member 24.

The grooves 44 in the base portion 42 are formed in a recessed manner in the surface 42*a* in alignment in the lengthwise direction of the base portion maintaining a predetermined distance, and are extending straight in the transverse direction of the base portion. The above-mentioned bearing surfaces 28 are formed on the bottom surfaces of the grooves 44 in a region neighboring one side edge of the base portion 42 extending between the engaging sections 46. The grooves 44 have such shapes and sizes as to separately receive a plurality of wires W that are to be connected by the connector 10 and, particularly, the conductors C from which the sheaths S are removed in a state of being stretched straight, as well as to separately receive the conductor-connecting sections 14 of the terminal elements 12 supported by the first support member 22. As will be described later, the grooves 44 work as wire-holding sections for arranging the wires W on the back side of the fitting portion 26 of the first support member 22 as seen in the connector fitting direction.

The engaging sections 46 have bag-like walls 46*a* protruding beyond the surface 42*a* of the base portion 42 at opposing ends in the lengthwise direction thereof. Guide grooves 48 are formed between the walls 46*a* and the surfaces 42*a* of the base portion, and are opening in the directions in which they face each other. Introduction portions 48*a* are formed in the guide grooves 48 in the engaging sections 46 on the side neighboring the bearing surfaces 28 of the grooves 44 as seen in the transverse direction of the base portion 42. The guide grooves 48 have a shape and a size for receiving the protuberances 38 protruded on the edge walls 34 of the first support member 22 in a sliding and complementary manner.

Figure 7:
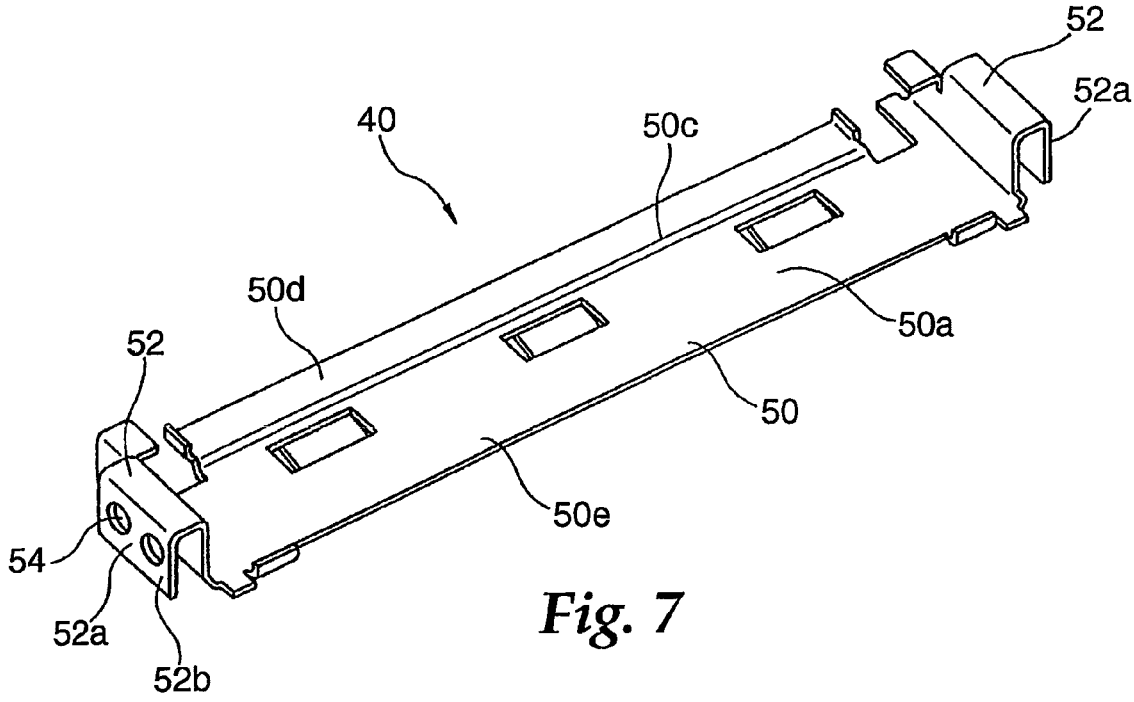
FIG. 7 is a perspective view of a first shield member in the connector of FIG. 1.

The first shield member 40 is a thin plate member formed in a predetermined shape by, for example, pressing a metal blank having good electric conduction, and includes a base plate portion 50 of nearly a rectangular shape as seen in a plan view and is integrally incorporated in the base portion 42 of the second support member 24, and a pair of end plate portions 52 protruded on the side of one surface 50*a* of the base plate portion 50 at opposing ends in the lengthwise direction thereof and are integrally incorporated in the engaging portions 46 of the second support member 24 (FIG. 7). The base plate portion 50 is arranged with its back surface 50*b* on the side opposite to the front surface 50*a* thereof being exposed on the back surface 42*a* of the base portion 42 of the second support member 24 (FIG. 4).

If described in further detail, the base plate portion 50 has a step portion 50*c* extending in the lengthwise direction. A region 50*d* (called contact region 50*d*) swelling on the side of the front surface 50*a* via the step portion 50*c* has its back surface 50*b* exposed on the back surface 42*b* of the base portion 42 at a position facing the bearing surfaces 28 of the base portion 42 of the second support member 24. Further, the region of the base plate portion 50 swelling on the side of the back surface 50*b* via the step portion 50*c*, is extending on the region 50*e* (referred to as junction region 50*e*) near the end thereof beyond the edge of the base portion 42 of the second support member 24 on the side separated away from the bearing surfaces 28. Therefore, the junction region 50*e* of the base plate portion 50 is arranged at a position neighboring the group of grooves 44 in the base portion 42 with its surface 50*a* being exposed (FIG. 2).

The end plate portions 52 of the first shield member 40 are extending upright in a U-shape in cross section from the ends of the base plate portion 50 in the lengthwise direction being folded and directed, outward, and have engaging regions 52*a* at the outer ends thereof. The engaging regions 52*a* of the end plate portions 52 are arranged with their outer surfaces 52*b* exposed to the outer side on the walls 46*a* of the engaging sections 46 of the second support member 24. A pair of dents 54 are locally formed in the outer surfaces 52*b* of the engaging regions 52*a* of the end plate portions 52. In the engaging sections 46 of the second support member 24, notches 56 are formed in the outer end surface of the wall portions 46*a* as seen in the lengthwise direction of the base portion 42 neighboring the engaging regions 52*a* of the first shield member 40 (FIG. 1).

When the first support member 22 and the second support member 24 are properly combined together, the outer surface 32*b* of the base portion 32 of the first support member 22 is placed on the surface 42*a* of the base portion 42 of the second support member 24 in contact therewith, and the edge walls 34 of the first support member 22 have its regions at the opposing ends in the lengthwise direction arranged neighboring the guide grooves 48 in the engaging sections 46 of the second support member 24. At this moment, the terminal elements 12 supported by the first support members 22 have their arm sections 14*a* of the conductor-connecting sections 14 separately received by the grooves 44 formed in the second support member 24 so as to be arranged facing the corresponding bearing surfaces 28. Further, the protuberances 38 protruded at the opposing ends of the first support member 22 in the lengthwise direction are received in a complementary manner by the guide grooves 48 formed in a recessed manner in the opposing ends of the second support member 24 in the lengthwise direction, whereby the support members 22 and 24 are held at properly combined positions. Further, the first shield member 40 has the back surface 50*b* of the base plate portion 50 and has the outer surfaces 52*b* of the engaging regions 52*a* at the end plate portions 52 arranged being exposed to the outer side at positions separated away from the first support member 22.

The abutting member 20 is integrally formed by, for example, injection-molding an electrically insulating resin material while incorporating therein the second shield member 58 that will be described later in a predetermined arrangement. The abutting member 20 includes a rod-like base portion 60 of nearly a rectangular shape as seen in a plan view and having a plurality of grooves 62 in one surface 60*a* thereof, edge walls 64 protruding from the outer edges of the surface 60*a* of the base portion 60 and extending in a U-shape as seen in a plan view, and a pair of engaging sections 66 formed on the outer sides of the edge walls 64 at opposing ends of the base portion 60 in the lengthwise direction thereof. It is also allowable to employ a constitution in which the second shield member of a suitable shape is incorporated in the abutting member which has been molded in a suitable shape in advance instead of the illustrated constitution in which the second shield member 58 is insert-molded in the abutting member 20.

The grooves 62 in the base portion 60 are formed in a recessed manner in the surface 60*a* in alignment in the lengthwise direction of the base portion maintaining a predetermined distance, and are extending straight in the transverse direction of the base portion. The pressing surfaces 68 are formed on the bottom surfaces of the grooves 62 facing the conductor-connecting sections 14 of the terminal elements 12 supported by the first support member 22 (FIG. 5). The grooves 62 have such shapes and sizes as to receive, particularly, the pressure-receiving portions 14*b* of the conductor-connecting sections 14 of the terminal elements 12.

The edge walls 64 are so extending as to close the grooves 62 at one end in the transverse direction of the base portion. Each groove 62 has an introduction surface 62*a* extending in a tapered manner from the pressing surface 68 toward a direction in which the groove 62 expands neighboring the pressing surface 68 of the base portion 60 on the side of the outer surface 60*b* which is the other end in the transverse direction. The edge walls 64 work in cooperation with the front surface 60*a* of the base portion 60 to define a cavity 70 for partly receiving the base portion 42 of the second support member 24 of the body 18. The engaging portions 66 are provided with pole-like portions 66*a* protruding toward the outer side beyond the outer surface 60*b* neighboring the opposing ends of the base portion 60 in the lengthwise direction.

Figure 8:
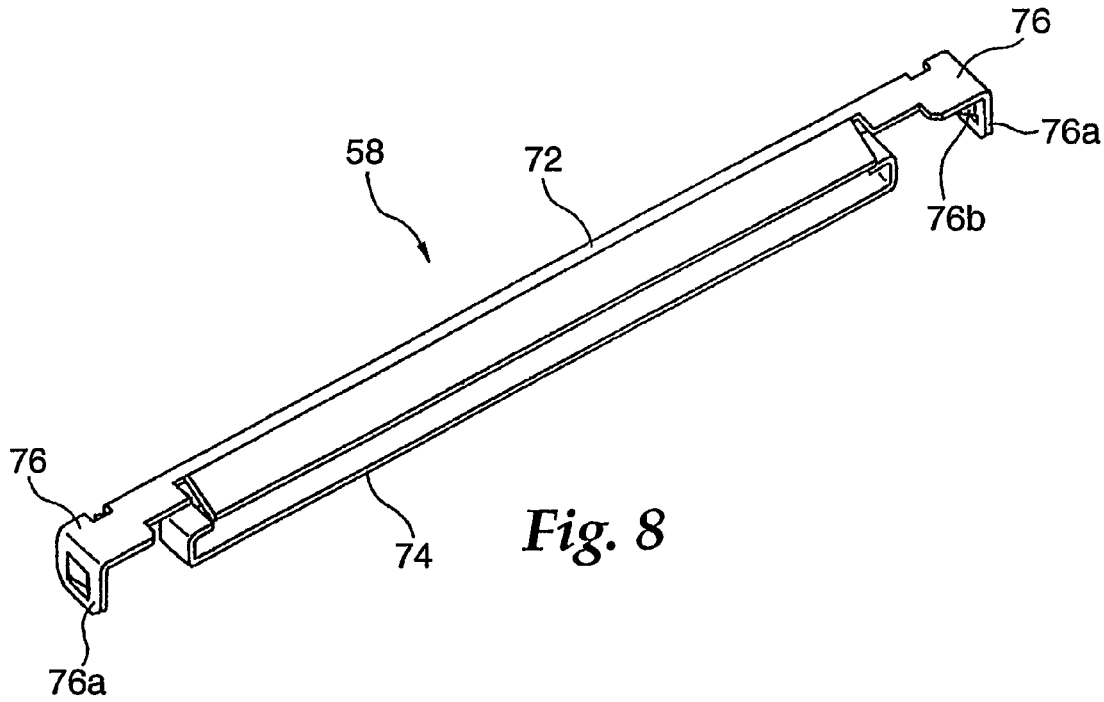
FIG. 8 is a perspective view of a second shield member in the connector of FIG. 1.

The second shield member 58 is a thin plate member formed in a predetermined shape by, for example, pressing a metal blank having good electric conduction, and includes a base plate portion 72 of nearly a V-shape in cross section and is integrally incorporated in the base portion 60 and the edge walls 64 of the abutting member 20, a contact portion 74 extending nearly at right angles with the base plate portion 72 along an edge in the lengthwise direction of the base plate portion 72 and arranged facing the surface 60*a* of the base portion protruding outward beyond the regions at the ends of the edge walls 64 that are extending in the lengthwise direction of the abutting member 20, and a pair of end plate portions 76 extending outward from the opposing ends in the lengthwise direction of the base plate portion 72 and arranged protruding toward the outer side of the engaging portions 66 of the abutting member 20 (FIG. 8).

The base plate portion 72 is arranged at a position to substantially surround a plurality of grooves 62 from the back side inside the base portion 60 and the edge walls 64 of the abutting member 20. The contact portion 74 protrudes beyond the edge walls 64 of the abutting member 20 and is arranged at a position facing the group of grooves 62 thereby to define the cavity 70 in cooperation with the base portion 60 and the edge walls 64. Each end plate portion 76 has a latch region 76*a* that is folded in an L-shape in cross section from one end of the base plate portion 72 in the lengthwise direction and is extending outward. An engaging piece 76*b* is formed like a cantilevered beam on the latch region 76*a* of the end plate portion 76 nearly at the center of the outer end thereof extending toward the base plate portion 72 in a tilted manner.

The abutting member 20 is securely fitted maintaining a predetermined positional relationship to the body 18 which is assembled by the first and second support members 22 and 24. When the abutting member 20 is properly fitted to the body 18, the outer surface 60*b* of the base portion 60 of the abutting member 20 is arranged in substantial contact with the outer surface 34*b* of the edge wall 34 of the first support member 22, whereby the conductor-connecting sections 14 of the terminal elements 12 supported by the first support member 22 and a portion having bearing surfaces 28 of the base portion 42 of the second support member 24 neighboring the conductor-connecting sections 14, are received by the cavity 70 of the abutting member 20. In this state, the grooves 62 of the abutting member 20 and the grooves 44 of the second support member 24 are arranged in alignment in position, and the pressing surfaces 68 of the abutting member 20 are arranged being opposed to the corresponding bearing surfaces 28 of the second support member 24 in parallel and spaced apart. Here, the gap between the pressing surfaces 68 and the bearing surfaces 28 facing each other, is smaller than the maximum distance L (FIG. 3) between the arm section 14*a* of the conductor-connecting section 14 of the terminal element 12 and the pressure-receiving portion 14*b* of under the no-load condition.

As a result, the conductor-connecting section 14 of each terminal element 12 has its pressure-receiving portion 14*b* received by the groove 62 of the abutting member 62, and is elastically or plastically deflected between the pressing surface 68 and the bearing surface 28.

In a state where the abutting member 20 is properly fitted to the body 18, the second shield member 58 incorporated into the abutting member 20 comes into conductive contact with the contact region 50*d* (FIG. 4) of the first shield member 40 incorporated into the second support member 24 at the contact portion 74. In this state, the first and second shield members 40 and 58 are arranged at positions substantially surrounding the conductor-connecting sections 14 of the terminal elements 12 in a non-contacting manner. When the abutting member 20 is assembled with the body 18, further, the end plate portions 76 of the second shield member 58 have their latch regions 76*a* arranged on the outer sides of the walls 46*a* of engaging portions 46 of the second support member 24, whereby the engaging pieces 76*b* are snap-fitted into the corresponding notches 56. Therefore, the abutting member 20 is securely held in a state of being assembled with the body 18. Here, the pole-like portions 66*a* of the engaging portions 66 of the abutting member 20 are fitted into the guide grooves 48 of the corresponding engaging portions 46 of the second support member 24, and are substantially abutted to the protuberances 38 of the first support member 22 received by the guide grooves 48. Accordingly, the first support member 22 and the second support member 24 are maintained in a properly assembled state.

Described below with reference to FIGS. 9 to 13 are the procedure for connecting the wires to the connector 10 having the above-mentioned constitution and the steps of assembling dealing with a case of handling a flat multi-core coaxial cable.

As a preparatory work, first, the conductors C are exposed at the ends of a plurality of wires (flat multi-core coaxial cable) by removing stepwise the sheath S, the inner shielding G and the insulating layer (not shown) over a required length. The wires W thus treated at their ends are separately inserted in the grooves 44 in the second support member 24 of before being assembled with the first support member 22, and the conductors C of the wires W are arranged along the bearing surfaces 28 of the corresponding grooves 44. Here, the portions of the wires W where the shielding G is exposed are extending outward from the corresponding grooves 44, and are placed on the junction region 50*e* of the first shield member 40 incorporated into the second support member 24 (FIG. 9(*a*)).

Here, there is provided a grounding plate 78 (FIG. 1) made of a thin metal plate having good electric conduction and a shape corresponding to the exposed surface of the junction region 50*e*. The grounding plate 78 is uniformly secured to the shieldings G of all wires W via, for example, a solder 80, and is joined to the junction region 50*e* of the first shield member 40 (FIGS. 9(*a*) and 10). Therefore, the wires W are securely held in the corresponding grooves 44 of the second support member 24, and the shieldings G of the wires W are electrically connected to the first common shield member 40. The grounding plate 78 may be temporarily anchored to the shieldings G of the flat wires W by using an adhesive or the like. Further, the conductors C of the wires W may be exposed to be slightly long so as to extend beyond the grooves 44 when they are inserted in the grooves 44, and the excess of portions of the wires W may be removed by cutting after the grounding plate 78 is soldered.

Figure 9A:
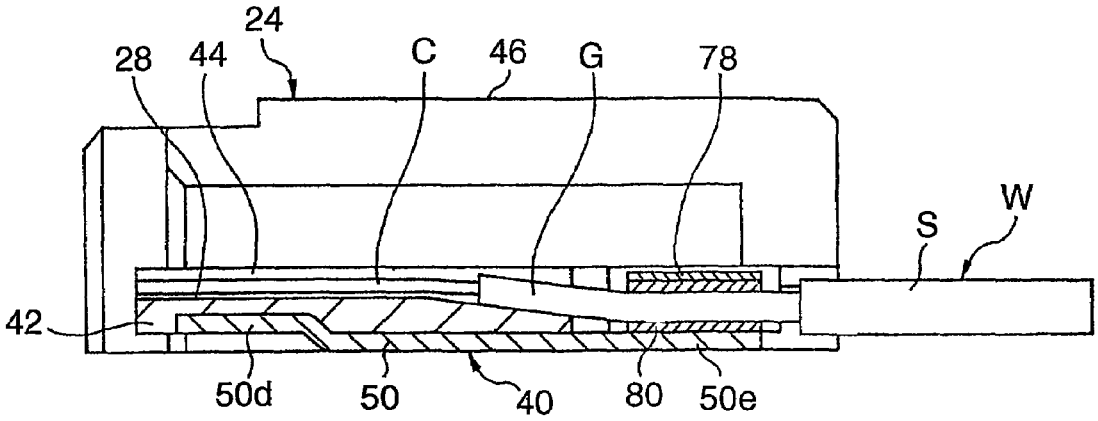
FIG. 9 is a view illustrating a procedure for connecting the wires by using the connector of FIG. 1, wherein (a) illustrates a state where the wires are arranged, (b) illustrates a state where the body is combined together, and (c) states a state where the connection is completed.
Figure 9B:
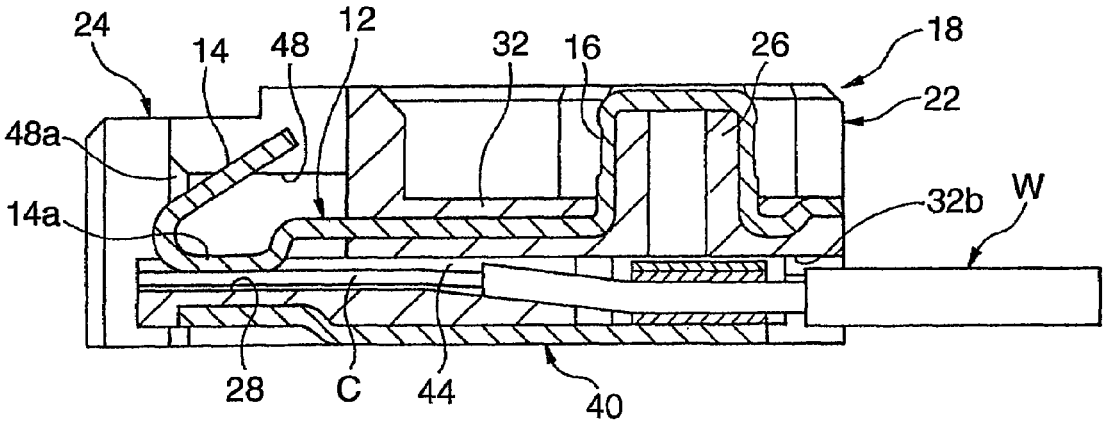
Figure 9C:
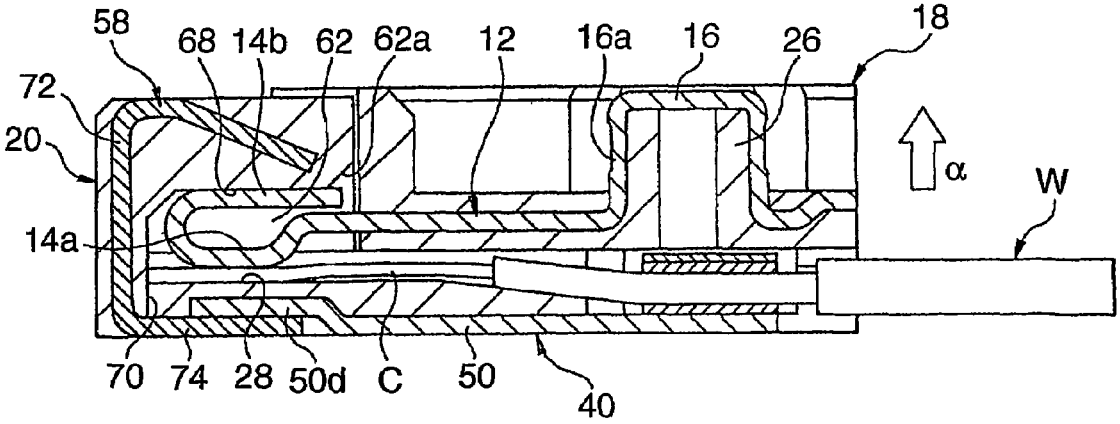
Figure 10:
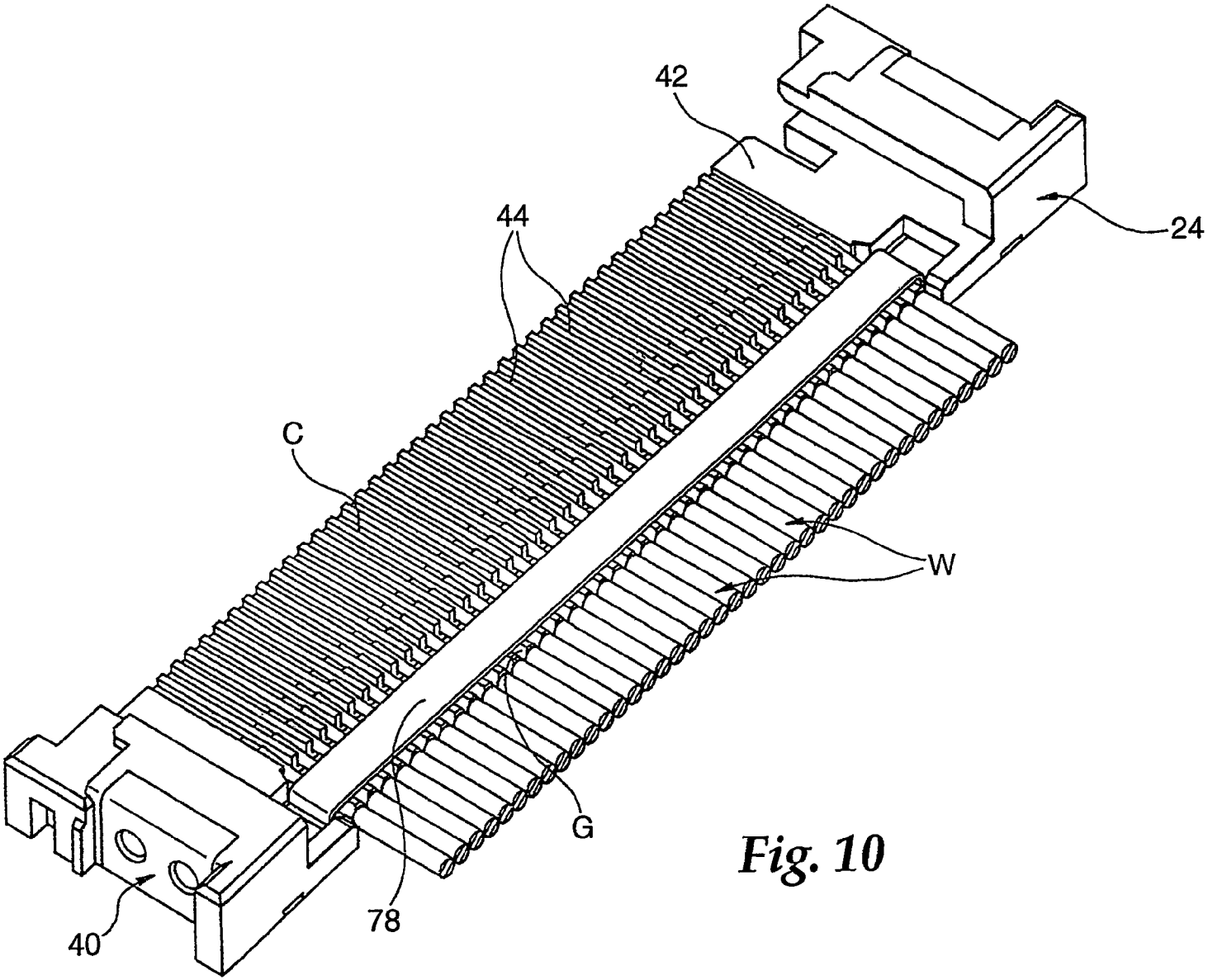
FIG. 10 is a perspective view of the first support member in a state where the wires are arranged of FIG. 9(*a*).
Figure 11:
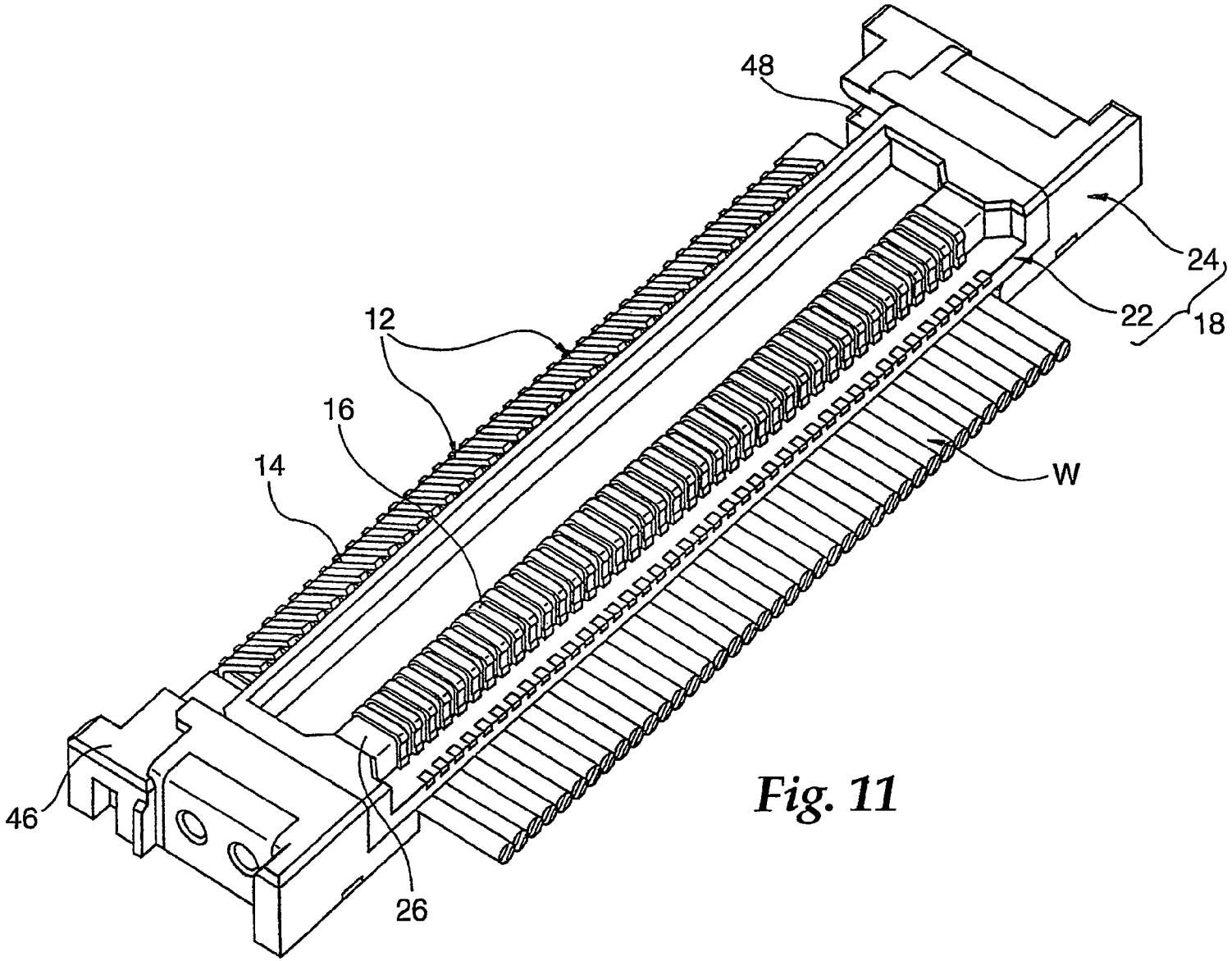
FIG. 11 is a perspective view of the body of having been combined together of FIG. 9(*b*).

The first support member 22 is combined with the second support member 24 securely supporting the wires W, i.e., the protuberances (FIG. 1) at the opposing ends of the first support member 22 in the lengthwise direction are slidably inserted in the guide grooves 48 at the opposing ends of the second support member 24 in the lengthwise direction through the introduction ports 48*a*, so as to be combined together at suitable positions thereby to form the body 18 (FIGS. 9(*b*) and 11). In this state, the terminals 12 supported by the first support member 22 have their arm sections 14*a* of the conductor-connecting sections 14 received by the corresponding grooves 44 of the second support member 24. Therefore, the conductors C of the wires W that have been inserted in the grooves 14 and have been positioned on the bearing surfaces 28, are now arranged between the conductor-connecting sections 14 of the terminal elements 12 and the bearing surfaces 28 of the corresponding grooves 44. Here, the shape of the conductor-connecting sections 14 of the terminal elements 12 may be so contrived that the conductors C are lightly held between the arm sections 14*a* and the bearing surfaces 28. Owing to the suitably combined state of the body 18, further, the wires W are arranged along the outer surface 32*b* of the base portion 32 of the first support member 22, and the portions where the shield layers G are exposed are arranged on the back side of the fitting portion 26 as seen in the connector fitting direction.

Figure 12:
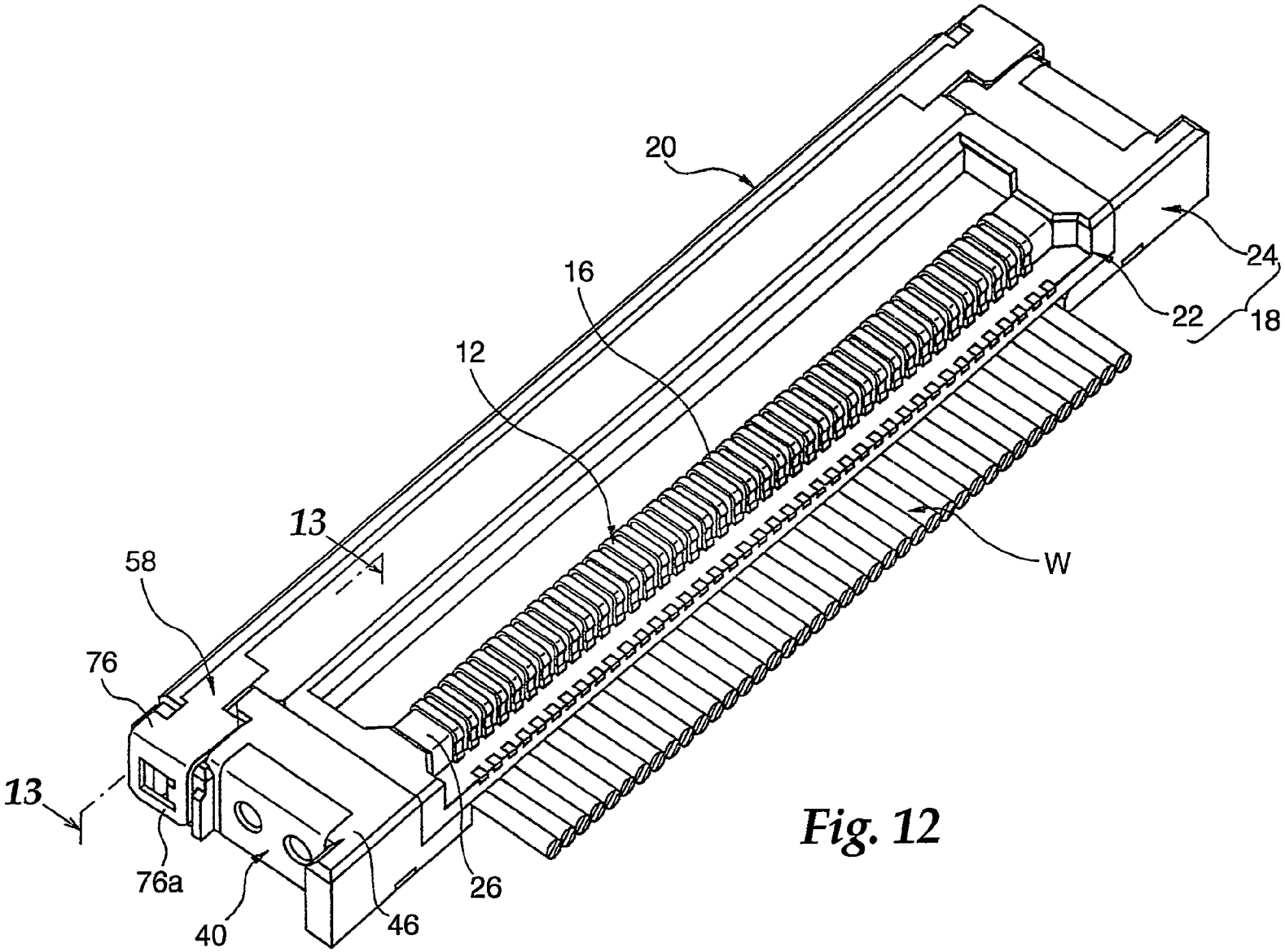
FIG. 12 is a perspective view of the connector of after the connection has been completed of FIG. 9(*c*).
Figure 13:
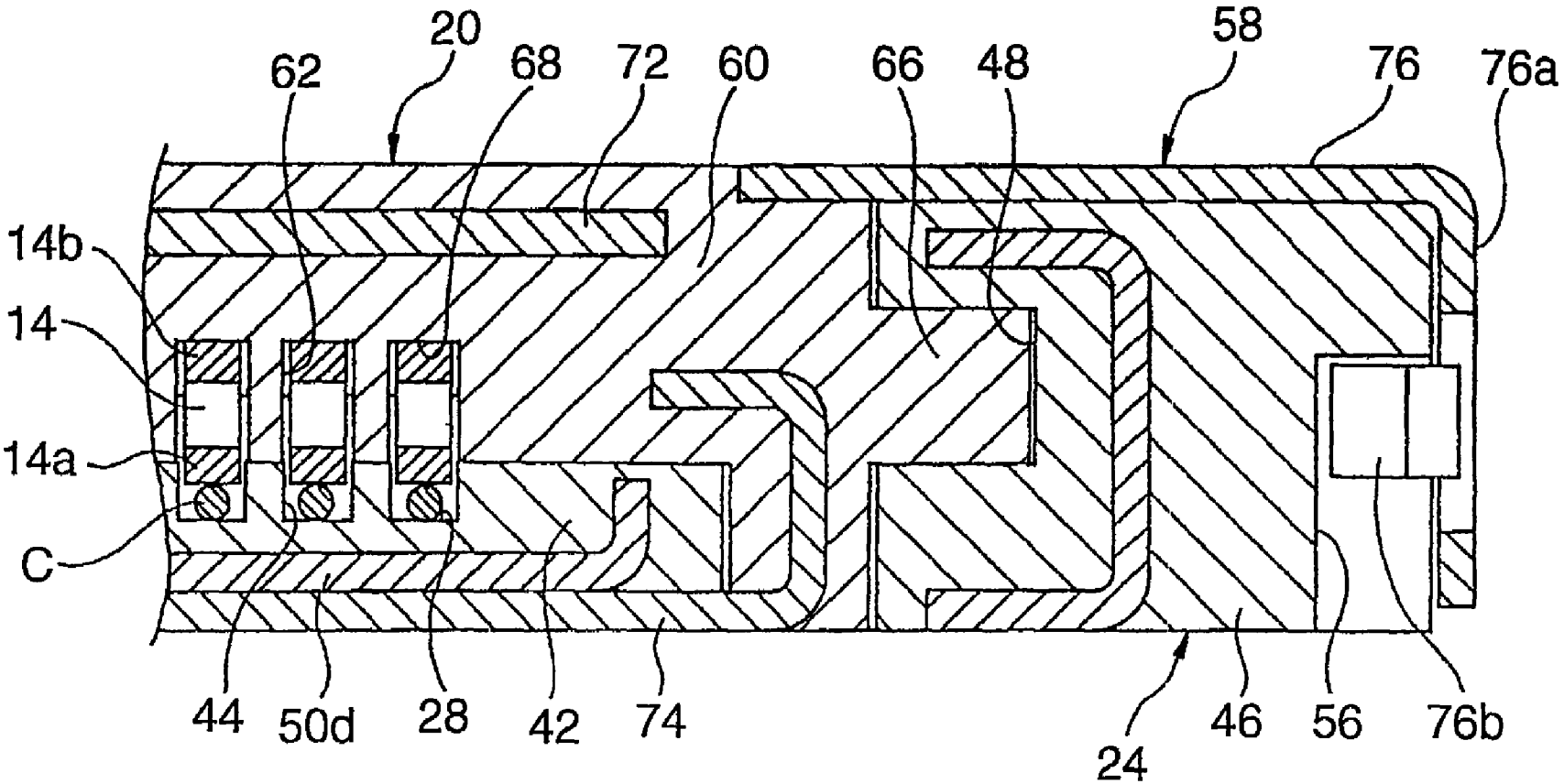
FIG. 13 is a sectional view illustrating, on an enlarged scale, a portion along a line XIII-XIII in FIG. 12.

The abutting member 20 is securely fitted to the body 18 that is securely holding the wires W as described above by having the conductor-connecting sections 14 of the terminal elements 12 supported by the first support member 22 and a portion having the bearing surfaces 28 of base portion 42 of the second support member 24 received by the cavity 70 formed in the abutting member 20 (FIG. 9(*c*)). Here, as described above, the pole-like portions 66*a* of the engaging portions 66 of the abutting member 20 are fitted into the guide grooves 48 in the engaging portions 46 of the second support member 24, and the latch regions 76*a* of the end plate portions 76 of the second shield member 58 are snap-inserted in the notches 56 in the engaging portions 46 of the second support member 24. Therefore, the first and second support members 22, 24 in the body 18, and the abutting member 20 are securely held at proper positions relative to each other (FIGS. 12 and 13).

In fitting the abutting member 20 to the body 18, the grooves 62 of the abutting member 20 are brought into positional match with the grooves 44 in the second support member 24, and the pressing surfaces 68 of the abutting member 20 and the bearing surfaces 28 of the second support member 24 are arranged facing each other being spaced apart by a distance smaller than the maximum distance L between the arm sections 14*a* of the conductor-connecting sections 14 of the terminal elements 12 and the pressure-receiving portions 14*b* of when there is no load. Therefore, the conductor-connecting sections 14 of the terminal elements 12 are forcibly introduced into the grooves 62 in a manner that the pressure-receiving portions 14*b* slide along the introduction surfaces 62*a* of the grooves 62 of the abutting member 20. With the abutting member 20 being suitably fitted, therefore, the conductor-connecting portions 14 of the individual terminal elements 12 are elastically or plastically deflected due to a pressure which the pressure-receiving portions 14*b* receive from the corresponding pressing surfaces 68, and the arm sections 14*a* are uniformly pressed onto the corresponding receiving surfaces 28. Accordingly, the conductors C of the wires W arranged in the grooves 56 of the second support member 24 are securely held between the arm sections 14*a* of the conductor-connecting portions 14 of the terminal elements 12 and the corresponding bearing surfaces 28 of the second support member 24.

The reaction produced by the deformation of the conductor-connecting sections of the terminal elements 12 at the time when the abutting member 20 is fitted to the body 18, is structurally received by the complementary engagement between the engaging portions 66 of the abutting member 20 and the engaging portions 46 of the second support member 24, by the engagement between the end plate portions 76 of the second shield member 58 and the engaging portions 46 of the second support member 24, and by the engagement between the contact portion 74 of the second shield member 58 and the contact region 5O*d* of the first shield member 40 (and the base portion 42 of the second support member). Thus, the conductors C of the wires W are connected to the terminal elements 12 of the connector 10 with a required contact pressure maintaining stability to complete the assembly of the connector 10.

In a state where the assembly of the connector 10 is completed, the fitting direction α of the connector defined by the fitting portion 26 of the body 18 is in agreement with the direction in which are extending the contact point lengths 16*a* of the contact sections 16 of the terminal elements 12 as described earlier (FIG. 9(*c*)). In the connector 10, therefore, the conductor-connecting sections 14 of the terminal elements 12 and the contact sections 16 are arranged being aligned in a direction nearly at right angles with the fitting direction α of the connector. Besides, the fitting direction a of the connector 10 is nearly at right angles with the direction in which the wires W are extending on the body 18.

In the connector 10 as described above, the conductor-connecting sections 14 and the contact sections 16 of the terminal elements 12 are arranged being aligned in a direction nearly at right angles with the fitting direction α of the connector. Therefore, the structure for connecting the conductor-connecting sections 14 of the terminal elements 12 and the conductors C of the wires W can be arranged being suitably deviated in a direction nearly at right angles with the fitting direction α of the connector (i.e., in a direction in which the wires W are extending on the body 18) relative to the fitting portion 26 of the body 18. As a result, as compared to the constitution in which the conductor-connecting portions and the contact portions of the terminal elements are aligned in the connector fitting direction disclosed in the patent literature 2 described above, an increase in the height of the connector 10 (external size in the fitting direction α of the connector) can be effectively avoided. Here, the connector 10 is employing a wire connection structure of a very simple conductor abut type in which the conductor-connecting sections 14 of the terminal elements 12 are pressed onto the conductors C of the wires W and are connected thereto. The above characteristic arrangement of the terminals 12 does not at all affect the connection between the terminal elements 12 and the wires W. Therefore, the connector 10 makes it possible to decrease the external size (particularly, height) thereof as much as possible without impairing the stability and reliability of connection between the terminal elements 12 and the wire conductors C.

Besides, the fitting direction α of the connector 10 is nearly at right angles with the direction in which the wires W extend on the body 18. As compared to the constitution in which the connector fitting direction is nearly in parallel with the direction in which the wires extend on the body disclosed in the patent literature 1 described above, therefore, an increase in the depth of the connector 10 (external size along the direction in which the wire extend) can be basically avoided. In the connector 10, in particular, the wires W are arranged on the back side of the fitting portion 26 as seen in the fitting direction α of the connector. As described above, therefore, an increase in the depth of the connector 10 can be effectively avoided even when the structure for connecting the conductor-connecting sections 14 of the terminal elements 12 to the conductors C of the wires W, is arranged being deviated in a direction in which the wires extend relative to the fitting portion 26 of the body 18.

In the connector 10, the body 18 is divided into the first support member 22 and the second support member 24, and the conductors C of the wires W to be connected are arranged in advance between the conductor-connecting sections 14 of the terminal elements 12 supported by the first support member 22 and the bearing surfaces 28 of the second support member 24. In connecting the wires, therefore, the wire conductors are not rubbed against the metal pieces with pressure unlike that of the prior art disclosed in the patent literature 1 described above, and the wire conductors C are not damaged. Upon properly incorporating the abutting member 20 into the body 18, therefore, the pressing surfaces 26 formed in the abutting member 20 uniformly press the conductor-connecting sections 14 of the terminal elements 12 onto the corresponding bearing surfaces 28. Therefore, a required contact pressure is easily maintained between the terminal elements 12 and the wire conductors C.

When the connector 10 is assembled, as described above, the first shield member 40 incorporated into the second support member 24 and the second shield member 58 incorporated into the abutting member 20 are brought into conductive contact with each other at their contact regions 50*d* and the contact sections 74. In this state, the first and second shield members 40 and 58 are arranged at such positions as to substantially surround the conductor-connecting sections of the terminal elements 12 and the conductors C of the wires W connected thereto in a non-contacting manner. The first and second shield members 40 and 58 having an equal potential being electrically connected to the shieldings G of the wires W, are connected to the ground potential of the counterpart connector thereby to establish a shielding structure of a high level for the signal transmission path in the connector system comprising the connector 10 and the counterpart connector and to improve high-speed transmission characteristics of the connector system.

The connector 10 having the above constitution employs a wire connection structure featuring excellent stability and reliability, and realizes a highly dense connection structure that meets the conductors C of small diameters of wires W and the arrangement of the terminal elements 12 maintaining a small pitch. The highly dense connection structure that can be realized in the connector 10 is of such a high level that the wire conductors C can have an outer diameter of not larger than 0.09 mm (not smaller than AWG (American Wire Gauge) 40) and a pitch in the arrangement of terminal elements 12 can be not larger than 0.3 mm. Further, the connector 10 that is realized has external sizes of, for example, 3 to 5 mm in depth and 1 to 2 mm in height.

Figure 14:
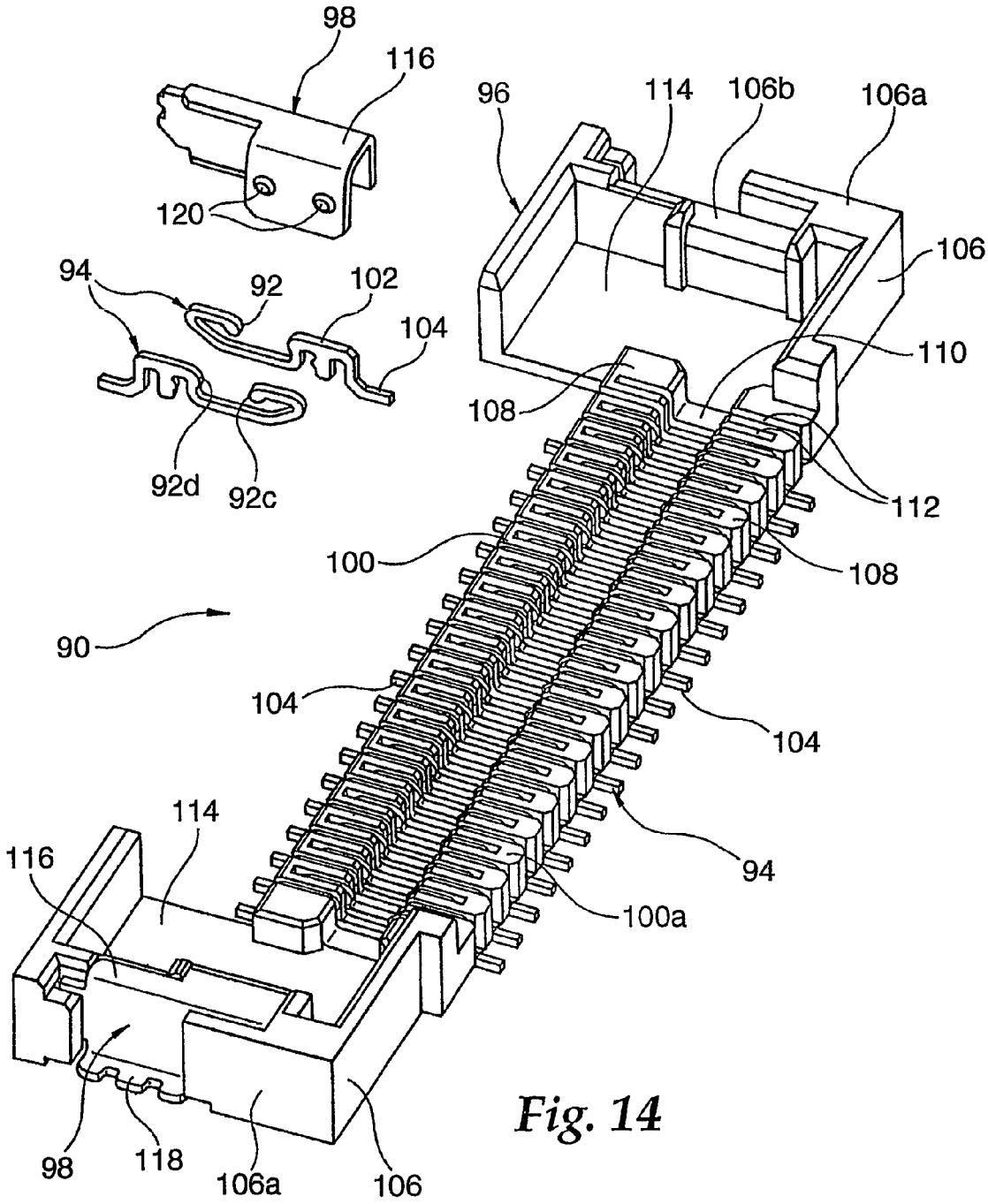
FIG. 14 is a perspective view illustrating, in a disassembled manner, a board connector according to the embodiment of the present invention that can be connected to the connector of FIG. 1.

FIG. 14 illustrates a board connector 90 according to an embodiment of the present invention constituted as a counterpart connector for the connector 10. The board connector 90 includes a plurality of terminals 94 having female contact sections 92 that come in conductive contact with the male contact sections 16 of the terminal elements 12 possessed by the connector 10, an electrically insulating body 96 for supporting terminal elements while exposing the contact sections 92, and a pair of grounding members 98 supported by the body 96 being insulated from the group of terminals 94 and are electrically connected to the first and second shield members 40 and 58 possessed by the connector 10. The body 96 is provided with a female fitting portion 100 that fits to the fitting portion 26 of the body 18 of the connector 10 in a complementary manner while positioning the contact sections 92 of the terminal elements 94 so as to be individually faced to the corresponding terminal elements 12 of the connector 10.

The terminals 94 of the board connector 90 have the same shape and size, and are supported being arranged in the fitting portion 100 of the body 96 maintaining an equal gap in parallel and in alignment. Each terminal element 94 is a pin-like member formed in a predetermined shape by, for example, press-molding a metal plate having good electric conduction, and includes integrally together an intermediate mounting section 102 that is attached being press-fit in the fitting portion 100 of the body 96, a contact section 92 on one end side extending from the mounting section 102 and is exposed on the surface of the fitting portion 100, and a lead section 104 on the other end side extending from the mounting section 102 on the side opposite to the contact section 92 and is protruding to the outer side of the body 96. The mounting section 102 of the terminal element 94 has an M-shaped in appearance with a press-fit piece 102*a* at the center thereof.

Figure 15:
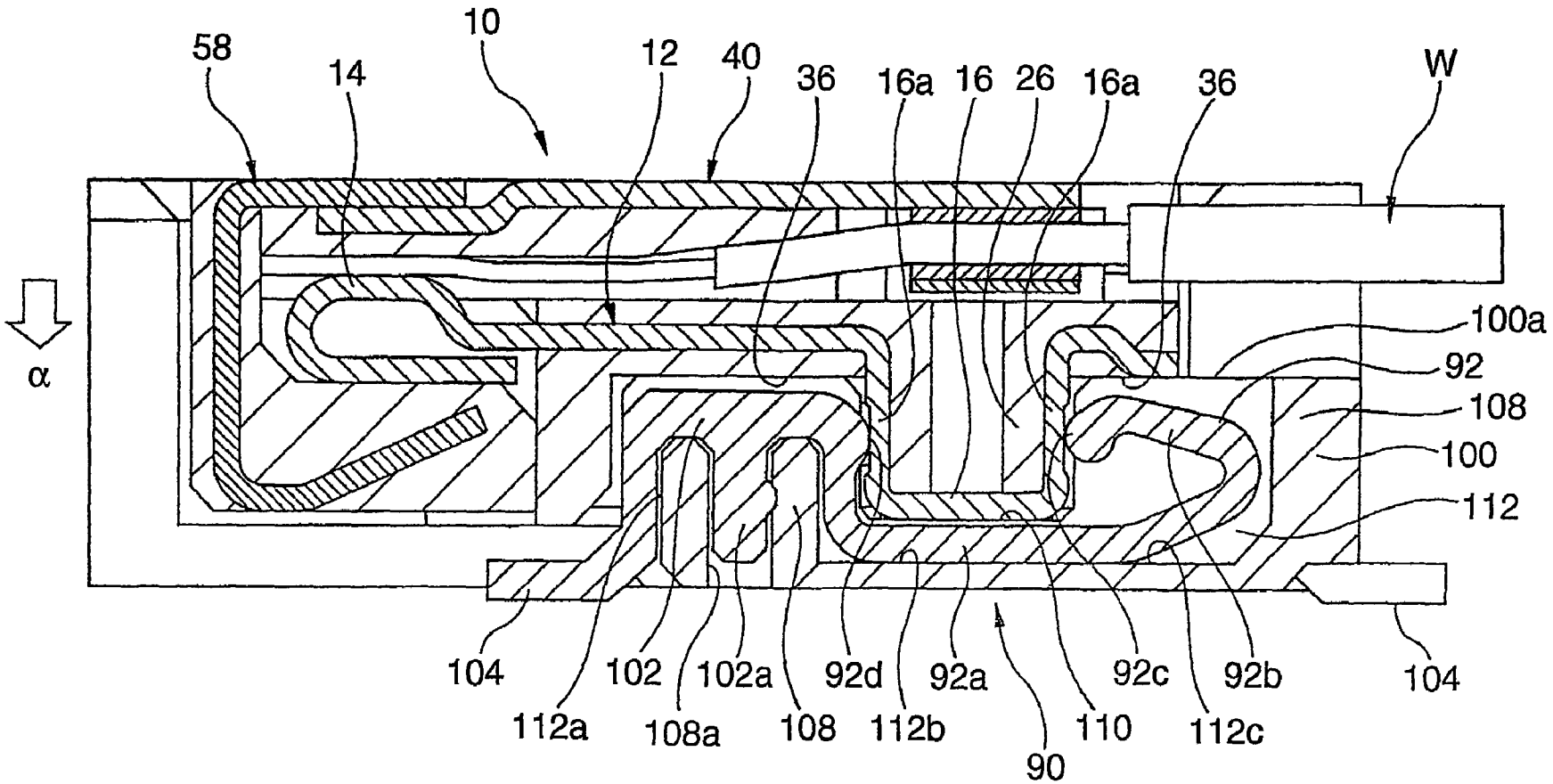
FIG. 15 is a sectional view illustrating a state where the connector of FIG. 1 and the board connector of FIG. 14 are connected to each other.

The contact section 92 of the terminal element 94 has a beam section 92*a* that extends straight from one end of the mounting portion 102 and a resilient arm section 92*b* that is connected in a folded manner to an end of the beam section 92*a* and is extending nearly in a V-shape in a direction to intersect the beam section 92*a* (FIG. 15). The contact section 92 is supported by the mounting section 102 in a cantilevered marmer, and the resilient arm section 92*b* resiliently deflects relative to the beam section 92*a* upon receiving an external force. The resilient arm section 92*b* of the contact section 92 has a contact point 92*c* at an end thereof. Further, another contact point 92*d* which is an element constituting the contact section 92 is formed on one leg of the mounting section 102 neighboring the contact section 92 at a position facing the contact point 92*c* of the resilient arm section 92*b*. The contact points 92*c* and 92*d* of the contact section 92 are constituting a first contact point 92*d* that is securely arranged on the fitting portion 100 and a second contact point 92*c* that is spaced apart from the first contact point 92*d* and is allowed to undergo a resilient displacement. In a no-load state where the resilient arm section 92*b* is not resiliently deformed, the contact points 92*c* and 92*d* of the contact section 92 are arranged being spaced apart by a distance which is slightly smaller than a distance across the exposed end surfaces of the contact point lengths 16*a* in the contact section 16 of the terminal element 12 in the connector 10.

The lead section 104 of the terminal element 94 extends straight from the other end of the mounting section 102, and is arranged slightly extending outward beyond the beam section 92*a* of the contact section 92. The lead section 104 protrudes outward beyond the body 96 so as to be connected to a conductor pad formed on a circuit board (not shown) on which the board connector 90 is mounted.

The body 96 is integrally formed by, for example, injection-molding an electrically insulating resin material, and includes the fitting portion 100 of nearly a rectangular shape on a plane which supports a plurality of terminal elements 94, and a pair of receiving portions 106 formed at both ends of the fitting portion 100 in the axial direction. The fitting portion 100 has a pair of protruded portions 108 extending in the lengthwise direction, and a recessed portion 110 is formed between the protruded portions 108 for receiving the fitting portion 26 of the connector 10 in a complementary manner. The fitting portion 100 has, on a surface 100*a* thereof, a plurality of grooves 112 in a recessed manner to separately receive a plurality of terminal elements 94. The grooves 112 are arranged in alignment in the lengthwise direction of the fitting portion 100 maintaining an equal gap corresponding to the group of terminal elements 12 arranged maintaining an equal gap in the connector 10, and are extending straight in a direction traversing the fitting portion and spanning across the two protruded portions 108 and the recessed portion 110. Each groove 112 is in the shape of a slit which is open at one end but is not opened at the other end as seen in a direction traversing the fitting portion 100, and the neighboring grooves 112 are opened at alternating ends.

In each groove 112, the mounting section 102 of the terminal element 94 is securely received by a region 112*a* that extends along the protruded portion 108 of the fitting portion 100 of the side that is open at an end, the beam section 92*a* of the contact section 92 of the terminal element 94 is securely received by a region 112*b* extending along the recessed portion 110 of the fitting portion 100, and a region 112 extending along the protruded portion 108 of the fitting portion 100 on the side that is not opening at the end has such a shape and size as to receive, in a swinging manner, the resilient arm section 92*b* of the contact section 92 of the terminal element 94 (FIG. 15). Further, each groove 112 has a hole 108*a* for tightly receiving the press-fit piece 102*a* of the mounting section 102 of the terminal element 94 inside the protruded portion 108 of the side that is open at the end. Therefore, the terminal elements 94 are so disposed that the contact sections 92 are arranged in parallel being alternately reversed so that the second contact point 92*c* of one terminal element 94 and the first contact point 92*d* of the other terminal element 94 are aligned among the neighboring terminal elements 94.

Owing to the characteristic shape of the contact sections 92, the terminal elements 94 attached to the fitting portion 100 are capable of obtaining a required contact pressure in a state where the second contact points 92*c* are resiliently displaced despite of a short spatial distance between the beam sections 92*a* and the second contact points 92*c*. As a result, this contributes to decreasing the height of the board connector 90 (external size as seen in the fitting direction $\alpha$ of the connector 10 to which the counterpart connector is to be connected. In the board connector 90, further, owing to the alternate arrangement of the terminal elements 94, the lead sections 104 of the terminal elements 94 alternately protrude to the opposite side from the fitting portion 100 and are arranged in a zig-zag manner on the outer side of the body 96. The zig-zag arrangement of the terminal lead sections 104 meets the above-mentioned highly densely connected structure of the connector 10, and makes it possible to decrease the pitch in the arrangement of the terminal elements 94.

In a state where each terminal element 94 is properly mounted in the groove 112 of the fitting portion 100 of the body 96, the contact points 92*c* and 92*d* of the contact section 92 are arranged protruding into the recessed portion 110 in the fitting portion 100. Therefore, if the fitting portion 26 of the connector 10 is inserted in the recessed portion 110 of the connector 90, the contact section 16 of the corresponding terminal element 12 of the connector 10 is inserted between the contact points 92*c* and 92*d* of the terminal element 94, and the resilient arm section 92*b* is resiliently deflected so as to be expanded outward. In this state, the contact points 92*c* and 92*d* of the terminal element 94 simultaneously come into conductive contact with the exposed end surfaces of the contact point lengths 16*a* of the terminal element 12 with a required contact pressure (FIG. 15). Thus, the connector system comprising the connectors 10 and 90 has a constitution in which the corresponding terminal elements 12 and 94 come into electric contact at two contact points. Therefore, even when the sizes of the terminal elements 12 and 94 are decreased to meet the above-mentioned highly densely connected structure, improved reliability is maintained in the electric contact of the contact points.

The receiving portions 106 of the body 96 have recessed portions 114 for receiving, in a complementary manner, the engaging portions 46 of the second support member 24 constituting the body 18 of the connector 10. Each receiving portion 106 has a mounting groove 106*b* formed at a predetermined position of the end wall 106*a* in the lengthwise direction defining the recessed portion 114 for mounting the grounding member 98.

Each grounding member 98 is a thin plate member formed in a predetermined shape by, for example, pressing a metal blank having good electric conduction, and has a board section 116 of a U-shape in cross section that is insertion-fitted into the mounting groove 106*b* of the receiving portion 106 of the body 96, and a terminal portion 118 extending outward from one end of the board section 116 nearly at right angles with the surface of the board section 116. The grounding member 98 is mounted on the mounting groove 106*b* with the terminal section 118 protruding outward beyond the end wall 106*a* of the receiving section 106 of the body 96. On the board section 116 of the grounding member 98, further, there are locally formed a pair of protrusions 120 on the end walls 106*a* of the receiving portion 106 at predetermined positions on the surfaces on the sides of the recessed portion 114.

Owing to the characteristic shape and arrangement of the terminal elements 94, the external size of the board connector 90 having the above-mentioned constitution can be decreased to meet highly dense mounting of the circuit board as described above. Further, the board connector 90 and the connector 10 are connected together in a proper positional relationship with the fitting portion 26 of the connector 10 being fitted to the recessed portion 110 of the fitting portion 100 of the connector 90 in a complementary manner and with the engaging portions 46 of the connector 10 being fitted to the recessed portions 114 of the receiving portions 106 of the board connector 90 in a complementary manner. In the thus properly connected state as described above, the corresponding terminal elements 12 and 94 are connected together being in contact at two points at the contact sections 16, 92 having a structurally male-female relationship. Besides, since the terminal elements 94 of the female side have been arranged with their contact sections 92 being alternately reversed, the resilient restoring force produced by the resilient arm sections 92*b* while in contact at two points is exerted on the group of terminal elements 12 (i.e., the fitting portion 26) of the connector to which the counterpart connector is to be connected from the second contact points 92*c* being balanced as a whole concerning the direction. Further, in addition to the complementary fitting between the fitting portions 26 and 100, and between the engaging portion 46 and the receiving portion 106, the protruded portions 108 of the fitting portion 100 of the board connector 90 are fitted into the recessed portions 36 in the first support member 22 of the connector 10 in a complementary manner. Therefore, even when the connector 10 receives an external force due to tensile force or twist applied to the wires W with respect to the board connector 90 structurally secured together with the circuit board, the electrically connected state between the corresponding terminal elements 12 and 94 is maintained with stability, i.e., the state where the two connectors 10 and 90 are properly connected together is maintained with stability irrespective of the direction of the external force.

Figure 16:
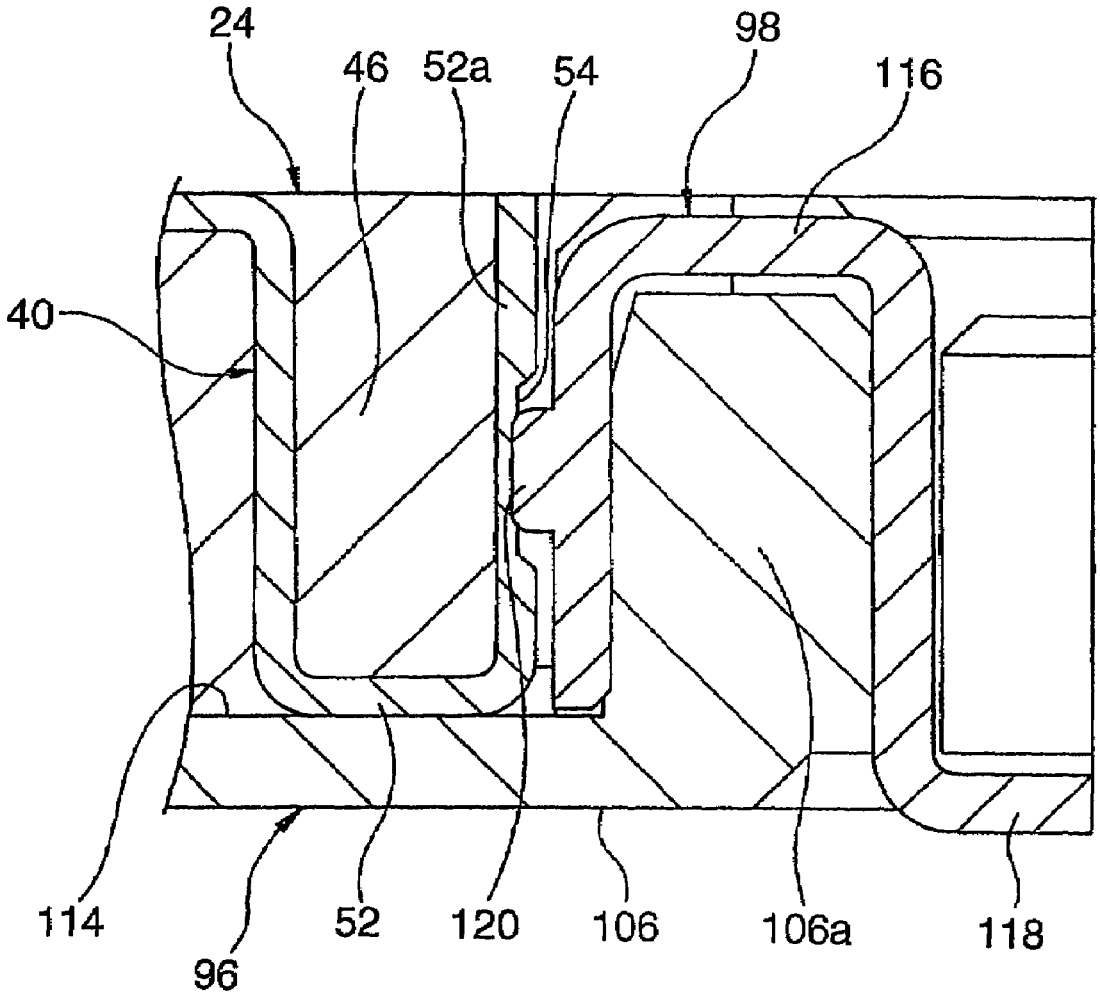
FIG. 16 is a sectional view illustrating, partly on an enlarged scale, a state where the connector of FIG. 1 and the board connector of FIG. 14 are connected to each other.

In the properly connected state, further, the first shield member 40 incorporated in the second support member 24 of the connector 10 is electrically connected to the grounding members 98 in a state where the protrusions 120 formed on the grounding members 98 of the board connector are received by the dents 54 formed in the engaging regions 52*a* of the end plate portions 52 (FIG. 16). The dents 54 of the first shield member 40 and the protrusions 120 of the grounding members 98 that are fitted together, work as a structural assistance for maintaining the properly connected state between the connector 10 and the board connector 90. Upon connecting the grounding members 98 of the board connector 90 to the grounding conductor formed on a circuit board (not shown) on which the board connector 90 is mounted at the terminal sections 118, further, the ground potential is imparted to the first and second shield members 40 and 58 of the connector 10. As a result, a shielding structure of a high level is established on a signal transmission path in the connector system comprising the connector 10 and the board connector 90, and the connector system features improved high-speed transmission characteristics.

Figure 17:
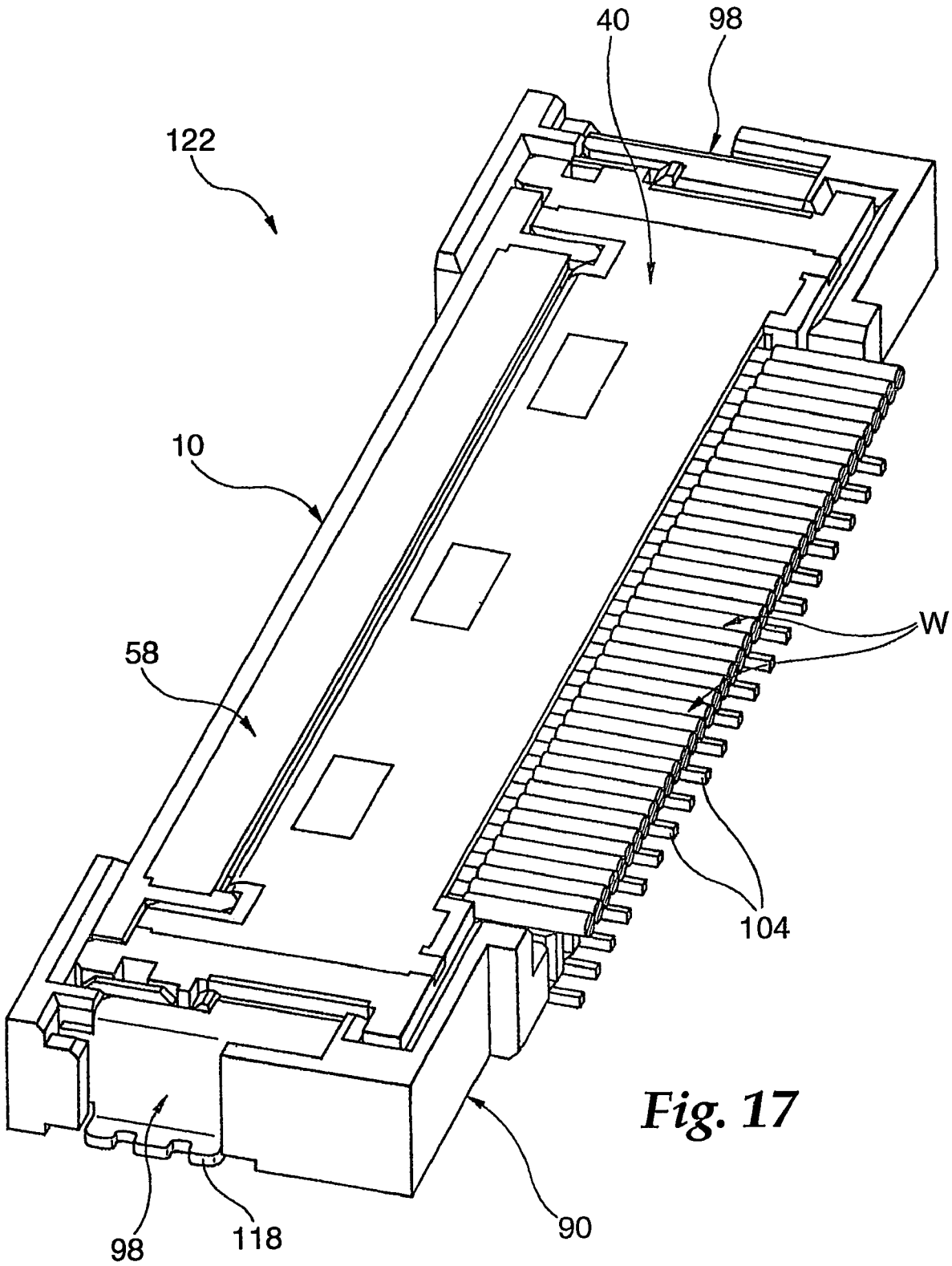
FIG. 17 is a sectional view illustrating a connector system in which the connector of FIG. 1 and the board connector of FIG. 14 are connected to each other.

FIG. 17 illustrates a connector system 122 in which the connector 10 and the board connector 90 are properly connected together. In the connector system 122, the external size of the whole system can be effectively decreased accompanying a decrease in the external sizes of the connectors 10 and 90 as described earlier. As a result, mounting space of the circuit board to which the connector system 122 is applied can be efficiently maintained to cope with a technology for highly dense mounting. Besides, owing to the above-mentioned characteristic mutual fitting structures of the connectors 10 and 90, the connector system 122 maintains a state where the connectors 10 and 90 are properly connected with stability.

INDUSTRIAL APPLICABILITY

The present invention provides a connector having a wire connection structure of the conductor abutting type in which the wire conductors are abut to the conductor-connecting sections of the terminal elements with pressure, a connector for circuit boards that can be connected to the above connector having the wire connection structure of the conductor abutting type, and a connector system including the above connectors. These connectors and connector system can be particularly effectively used in the applications where it is required to decrease the external sizes of the connectors as much as possible.

What is claimed is:

1. A connector comprising:

a terminal element including a conductor-connecting section connectable with a conductor of an electric wire and a contact section capable of coming into conductive contact with a corresponding terminal element of a counterpart connector;

an electrically insulating body for supporting said terminal element while exposing said conductor-connecting section and said contact section wherein said conductor-connecting section protrudes outwardly from a first support member of said body; and an abutting member assembled with said body to bring the conductor of the wire into abutment with said conductor-connecting section of said terminal element under pressure;

wherein said body includes a fitting portion capable of fitting to the counterpart connector while positioning said contact section of said terminal element with respect to the corresponding terminal element;

wherein said conductor-connecting section and said contact section of said terminal element are arranged to be aligned with each other in a direction intersecting a connector fitting direction determined by said fitting portion; and wherein said contact section of said terminal element has a folded shape such that the contact section is capable of conductively contacting with the corresponding terminal element of the counterpart connector at a plurality of points simultaneously, and wherein said fitting portion of said body includes a protruding support surface along which said contact section of said terminal element is securely supported.

2. A connector according to claim 1, wherein said body includes a wire-holding section for locating the wire on a backside of said fitting portion as seen in said connector fitting direction, and wherein said connector fitting direction intersects an extending direction of the wire on said body, said extending direction defined by said wire-holding portion.

3. A connector according to claim 1, wherein said body includes a first support member having said fitting portion and supporting said terminal element, and a second support member having a bearing surface facing said conductor-connecting section of said terminal element supported on said first support member and supporting the wire while positioning the conductor on said bearing surface; said first support member and said second support member being combined together in such a manner as to dispose said conductor between said conductor-connecting section and said bearing surface.

4. A connector according to claim 3, wherein said abutting member includes a pressing surface acting to press said conductor-connecting section of said terminal element supported on said first support member toward said bearing surface of said second support member, when said abutting member is assembled with said body.

5. A connector according to claim 3, further comprising a first shield member incorporated in said second support member and a second shield member incorporated in said abutting member in such a manner as to come into conductive contact with said first shield member; said first and second shield members being arranged at a position substantially surrounding said conductor-connecting section of said terminal element and the conductor of the wire in a non-contacting manner.

6. A connector according to claim 5, wherein the wire is a coaxial cable, and wherein said first and second shield members are capable of being electrically connected to a shielding of the coaxial cable supported on said second support member.

7. A connector comprising:

a plurality of terminal elements respectively including lead sections connectable with a circuit board and contact sections capable of coming into conductive contact with corresponding terminal elements of a counterpart connector; and an electrically insulating body for supporting said plurality of terminal elements while exposing said lead sections and said contact sections;

wherein said body includes a fitting portion capable of fitting to the counterpart connector while positioning said contact sections of said terminal elements with respect to the corresponding terminal elements;

wherein each of said contact sections of said plurality of terminal elements includes a first contact point fixedly arranged on said fitting portion and a second contact point spaced to be oppositely facing said first contact point in an elastically displaceable manner, said second contact point protruding outwardly from said body toward said first contact point;

wherein said plurality of terminal elements are disposed on said fitting portion in a parallel arrangement with said contact sections being alternately reversed, in such a manner that, among two terminal elements arranged side-by-side, said first contact point of one terminal element is aligned with said second contact point of the other terminal; and wherein said contact section of said terminal element has a folded shape such that the contact section is capable of conductively contacting with the corresponding terminal element of the counterpart connector at a plurality of points simultaneously, and wherein said fitting portion of said body includes a protruding support surface along which said contact section of said terminal element is securely supported.

8. A connector system comprising a connector according to claim 1 and a connector according to claim 7.

* * * * *

UNITED STATES PATENT AND TRADEMARK OFFICE

CERTIFICATE OF CORRECTION

PATENT NO. : 7,377,803 B2
APPLICATION NO. : 10/576844
DATED : May 27, 2008
INVENTOR(S) : Hiroyuki Matsuoka It is certified that error appears in the above-identified patent and that said Letters Patent is hereby corrected as shown below:

Title Page
Item [57], ABSTRACT, line 10, delete "fining" and insert -- fitting --, therefore.
Item [57], ABSTRACT, line 11, delete "fining" and insert -- fitting --, therefore.

Column 1
Line 36, delete "conductor" and insert -- conductors --, therefore.

Column 8
Line 30, delete "section" and insert -- sections --, therefore.

Column 13
Lines 52-56, delete "As a result, .....the bearing surface 28." and insert same on line 51 after "condition." as a continuation of paragraph.

Column 15
Line 66, delete "5Od" and insert -- 50d --, therefore.

Column 16
Line 14, delete "a" and insert -- α --, therefore.

Column 23
Line 9, in Claim 9, delete "terminal;" and insert -- terminal element; --, therefore.

Signed and Sealed this

Fifth Day of August, 2008

JON W. DUDAS
*Director of the United States Patent and Trademark Office*